US006054257A

United States Patent [19]

Boff et al.

[11] Patent Number: 6,054,257

[45] Date of Patent: Apr. 25, 2000

[54] PHOTOGRAPHIC ELEMENT CONTAINING PARTICULAR COUPLER AND INHIBITOR RELEASING COUPLER

[75] Inventors: Jane S. Boff, St. Albans; Bernard A. Clark, Maidenhead, both of United Kingdom; Louis E. Friedrich, Rochester; Stephen P. Singer, Spencerport, both of N.Y.

[73] Assignee: Eastman Kodak Company, Rochester, N.Y.

[21] Appl. No.: 09/014,851

[22] Filed: Jan. 29, 1998

[51] Int. Cl.[7] ..... G03C 1/08; G03C 7/26; G03C 7/32

[52] U.S. Cl. ..... 430/544; 430/505; 430/955; 430/957

[58] Field of Search ..... 430/505, 544, 430/957, 955

[56] References Cited

U.S. PATENT DOCUMENTS

| | | | |
|---|---|---|---|
| 2,289,803 | 7/1942 | Peterson | 430/544 |
| 2,296,306 | 9/1942 | Peterson | 430/544 |
| 2,308,023 | 1/1943 | Peterson | 430/544 |
| 2,353,754 | 7/1944 | Peterson | 430/544 |
| 2,412,700 | 12/1946 | Weissberger et al. | 430/544 |
| 2,756,142 | 7/1956 | Yutzy | 430/544 |
| 4,477,563 | 10/1984 | Ichijima et al. | 430/544 |
| 4,782,012 | 11/1988 | DeSelms et al. | 430/544 |
| 4,937,179 | 6/1990 | Hirano et al. | 430/544 |
| 5,004,677 | 4/1991 | Ueda | 430/382 |
| 5,441,857 | 8/1995 | Odenwalder et al. | 430/506 |
| 5,641,613 | 6/1997 | Boff et al. | 430/544 |
| 5,662,817 | 9/1997 | Wilsau et al. | 430/543 |

FOREIGN PATENT DOCUMENTS

| | | |
|---|---|---|
| 0167168 | 1/1986 | European Pat. Off. . |
| 0219713 | 4/1987 | European Pat. Off. . |
| 0440466 | 8/1991 | European Pat. Off. . |
| 0488310 | 6/1992 | European Pat. Off. . |
| 60-213945 | 10/1985 | Japan . |

*Primary Examiner*—Geraldine Letscher
*Attorney, Agent, or Firm*—Arthur E. Kluegel

[57] ABSTRACT

A photographic element is disclosed comprising:

a) a first light sensitive silver halide emulsion layer containing a compound of Formula I:

$$COUP_1—(L)_n—A \qquad I$$

wherein

1) $COUP_1$ is a coupler parent group capable of forming a dye upon reaction with oxidized developer wherein $—(L)_n—A$ is not attached to the coupling position;
2) L is a divalent linking group bonding A to $COUP_1$, and n is 0 or 1; and
3) A is a fragment containing a group is identified by formulas IIIa. IIIb or IIIc:

IIIa

IIIb

IIIc wherein: Het represents a heteroatom; Q represents the atoms necessary to form a five or six-membered ring; V represents an atom of oxygen, sulfur, or nitrogen; and U represents an ether, thoiether or amino group; provided that the indicated formulas encompass the addition of one or more fused rings; and provided that the ClogP for the compound of Formula I is not greater than 20; and b) a second light sensitive silver halide emulsion layer containing a compound of Formula II:

$$COUP_2—(TIME)_j—INH \qquad II$$

wherein:

1) $COUP_2$ is a coupler parent group capable of forming a dye upon reaction with an oxidized developer;
2) TIME is a timing group and j is 0 or 1; and
3) INH is a mild silver development inhibitor fragment.

The element provides improved color reproduction.

30 Claims, No Drawings

PHOTOGRAPHIC ELEMENT CONTAINING PARTICULAR COUPLER AND INHIBITOR RELEASING COUPLER

FIELD OF THE INVENTION

This invention relates to photographic materials and, more particularly, color photographic elements containing an Interimage Enabling Coupler in one light sensitive layer and in a second light-sensitive layer, an inhibitor releasing coupler.

BACKGROUND OF THE INVENTION

It has long been an object of silver halide-based color photographic materials to reproduce colors in a desired manner in terms of hue saturation. In practice, the reproduction of color by such materials is limited in several ways. First, the sensitivity of the silver halide emulsions to a desired single light color is not perfect and they will therefore absorb some amount of light of undesired color. This leads to formation of dye in the wrong color record resulting in less pure hues. For example, the red sensitivity of the emulsions generally occurs at longer wavelengths than the human eye. If the red sensitivity of the film is moved closer to the eye maximum sensitivity, its sensitivity to green light also increases. Thus in such situations, the red sensitive layer is partially exposed during green light exposures leading to the formation of some cyan dye along with magenta dye. This alters the hue of the image and decreases its saturation. Second, the image dyes formed are not perfect in hue and have unwanted side absorbances. Thus, some density in the unwanted color regions it formed in addition to the desired density, again degrading color saturation. Finally in some circumstances, it is desirable to increase color saturation to a greater degree than the actual image in order to make the image visually more pleasing.

It is well known too that color reproduction of such materials can be partially controlled by the use of imagewise development inhibitor releasing (DIR) couplers. During development, DIR couplers react with oxidized developer to release an inhibitor fragment or a precursor of an inhibitor fragment which can diffuse out of that layer and into a different color record where inhibition occurs. This has the overall effect of reducing the amount of dye formed in one color record as a function of exposure of another and can effectively be used to manipulate hue and increase color saturation. This process is called interimage. For example, a film with a DIR coupler in the green layer and given a mostly green exposure will cause a decrease in development in the red record due to the action of the inhibitor released in the green. This causes less cyan dye to be formed than when the inhibitor was not present. The final green image will have less red density and its overall saturation will be increased. It should be noted that all possible colors are not weighted equally in tennis of creating a pleasing overall image and that the reproduction of some key colors (for example, flesh tones, green grass, blue sky, etc.) is more important than others.

The creation of interimage effects with DIR couplers as currently practiced is deficient in a number of ways. First, the inhibitor fragment (or precursor) released from the DIR coupler is fire to diffuse in all directions. Thus, the inhibitor can affect both of the other color records, even if it was desired to affect only one. For example, putting the DIR coupler in the green record will decrease the amount of blue development as well as the red. The amount of interimage effects on the blue and red records from the green are linked and cannot be manipulated separately. This non-specificity of interimage effects limits the ability to control and manipulate color reproduction of the key colors. Second, the fragment released from the DIR will also cause inhibition in the layer in which it is released. This can lead to over-inhibition of the layer in which the DIR coupler is located resulting in low contrast and a loss of sensitivity to light, particularly with strong inhibitor fragments. It is possible to avoid this in part by using milder inhibitors or by using timing groups to delay the introduction of the free inhibitor fragment. In such situations, the diffusion pathlength of the inhibitor fragment is increased and seasoning of the fragments into the developer becomes a problem. In order to avoid these seasoning effects, mild inhibitor fragments often have a hydrolyzable substituent which, upon hydrolysis in the developer solution, renders them inactive after a period of time. Examples are shown in U.S. Pat. No. 4,782,012, U.S. Pat. No. 4,477,563, U.S. Pat. No. 4,937,179, U.S. Pat. No. 5,004,677, DE-A 3909486, DEA-3209486, EP-A-167, 168, EP-A-488,310, EP-A-440,466 and EP-A-219,173.

Couplers with potential silver absorbing or complexing groups are known. U.S. Pat. No. 2,353,754, U.S. Pat. No. 2,756,142, U.S. Pat. No. 2,308,023, U.S. Pat. No. 2,296,306, U.S. Pat No. 2,289,803, U.S. Pat. No. 2,412,700 and FR 1459811 all describe the use of color couplers that form insoluble silver salts to immobilize them in photographic systems. These couplers rely solely on the salt formation to prevent diffusion and are not additionally ballasted or substituted with additional anti-diffusion groups. All of the examples contained in these patents have ClogP (defined hereinafter) no higher than 4.25 indicating low hydrophobicity. Such materials tend to desensitize the silver emulsions to light and are inhibitors of silver development themselves.

DE 1 95 31569 A1 describes couplers that improve granularity that bear acidic residues that impart diffusively in an alkane medium as well as couplers that bear a precursor to a thiol group. Of the examples shown, only GB-3 (ClogP=10.46), PP-1 (ClogP=6.59) and PP-4 (ClogP=17.59) have groups with an —N—H or —S—H group and a ClogP greater than 6.25.

U.S. Pat. No. 5,158,864 describes couplers with silver absorbing or complexing groups to reduce the sensitivity/granularity ratio. These couplers must have a certain reactivity, have a preferred upper concentration limit of 1 mmol per mole of silver with an absolute upper limit of 10 mmol per mole silver and must not contain a diffusion inhibiting ballast residue. They are described as being soluble to some extent in aqueous media. Of 48 examples, the average ClogP is 3.09 with only HK11 (ClogP=10.87), HK16 (ClogP=6.72), HK28 (ClogP=6.28) and HK31 (ClogP=8.53)having a ClogP greater than 6.25.

U.S. Pat. Nos. 5,441,857 and 5,622,817 (describe ACR couplers, which are couplers that upon reaction with oxidized developer release a second coupler bearing a silver absorbing or complexing group to increase sensitivity. In these materials, the second coupler does not contain a ballast or anti-diffusion group nor is the silver absorbing or complexing group free to interact with the silver until after development and coupling of the first coupler. However, in the '857 reference, examples I-5 (ClogP=14.42), I-7 (ClogP=13.46) and I-8 (ClogP=8.60) contain groups with N—H or S—H bonds that could interact with silver.

A problem to be solved is to provide a color photographic element that will provide improved color reproduction.

SUMMARY OF THE INVENTION

The invention provides a photographic element comprising:

a) a first light sensitive silver halide emulsion layer containing a compound of Formula I:

$$COUP_1—(L)_n—A \qquad I$$

wherein

1) $COUP_1$ is a coupler parent group capable of forming a dye upon reaction with oxidized developer wherein $—(L)_n—A$ is not attached to the coupling position;
2) L is a divalent linking group bonding A to $COUP_1$, and n is 0 or 1; and
3) A is a fragment selected from the group consisting of those having formulas IIIa, IIIb, and IIIc:

IIIa

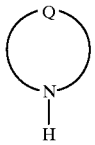

IIIb

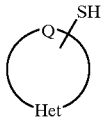

IIIc

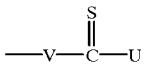

wherein: Het represents a heteroatom; Q represents the atoms necessary to form a five or six-membered ring; V represents an atom of oxygen, sulfur, or nitrogen; and U represents an ether, thioether or amino group; provided that the indicated formulas encompass the addition of one or more fused rings; provided that the ClogP for the compound of Formula I is not greater than 20; and b) a second light sensitive silver halide emulsion layer containing a compound of Formula II:

$$COUP_2—(TIME)_j—INH \qquad II$$

wherein:

1) $COUP_2$ is a coupler parent group capable of forming a dye upon reaction with an oxidized developer;
2) TIME is a timing group and j is 0 or 1; and
3) INH is a mild silver development inhibitor fragment.

The element provides improved color reproduction.

DETAILED DESCRIPTION OF THE INVENTION

The invention is generally as described in the Summary of the Invention. The invention relates to a light sensitive color photographic element typically containing at least one red sensitive silver halide emulsion layer having at least one non-diffusing cyan coupler, at least one green sensitive silver halide emulsion layer having at least one non-diffusing magenta coupler and at least one blue sensitive silver halide emulsion layer having at least one non diffusing yellow coupler. The presence of the Interimage Enabling Coupler (IEC) of Formula I in a first light sensitive silver halide emulsion layer serves to magnify the development inhibiting effect on that first layer of a mild development inhibitor releasing (DIR) coupler of Formula II originating in a second light sensitive silver halide emulsion layer of spectral sensitivity different from the first layer. The IBC coupler of Formula I is present in the layer where the inhibition is desired. The invention provides a color photographic element that will provide a more controlled interimage effect on a particular color record. Additionally, it accomplishes this result without greatly perturbing further layers and without over-inhibiting the layer in which the DIR coupler is located.

In Formulas I and II, $COUP_1$ and $COUP_2$ are independently selected coupler parent fragments or groups. COUP is the portion of a coupler compound that combines with oxidized developer to form a dye during conventional development processing. It may form a colored dye that permanently remains in the film, a colored species that washes out of the film, a colored species that is unstable and decomposes during processing of an uncolored species. In Formula I, $COUP_1$ can be two or four equivalent as described hereinafter. Examples of suitable groups for $COUP_1$ and $COUP_2$ are given hereafter but generally include phenols, naphthols, pyrazolones, pyrazoloazols, and open chain acylacetamide compounds.

L is an optional divalent linking group that chemically connects $COUP_1$ to A. It may be attached to any point of $COUP_1$ except the coupling site, such that A remains connected to COUP ever after reaction with oxidized developer. Representative examples of L are —O—, —S—, $—N(R_1)—$, $—N(R_1)CO—$ or $—CON(R_1)—$, $—SO_2—$, $—N(R_1)SO_2—$ or $—SO_2N(R_1)—$, $—(CH_2)_x—$ or $—(OCH_2CH_2OCH_2CH_2)_x—$where x=1 to 21, $—C_6H_4—$(o, m, or p), $—CO_2—$ or —CO— where $R_1$ is hydrogen, an alkyl or aryl group.

A is a fragment containing a group as identified by formulas IIIa, IIIb or IIIc:

IIIa

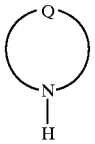

IIIb

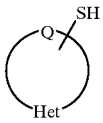

IIIc

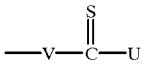

in which: Het represents a heteroatom; Q represents the atoms necessary to form a five or six-membered ring; V represents an at(om of oxygen, sulfur, or nitrogen; and U represents an ether, thioether or amino group; provided that the indicated formulas encompass the addition of one or moire fused rings. It is believed that A is a group that can absorb or complex to the silver halide surfaces of photographic silver halide emulsions. A cannot be attached to the coupling site of $COUP_1$. As indicated, there may be present one or more f used rings and the attachment to L or $COUP_1$ may be through one of the fused rings.

A compound represented by Formula ma has a five or six membered heterocyclic ring containing at least one, or more preferably two heteroatoms such as nitrogen or sulfur atoms and containing at least one —N—H bond. These compounds can be optionally benzo or naptho condensed and further substituted with additional groups such as ethlers, thioethers, halide atoms, cyano, sulfonyl and the like to manipulate the silver emulsion absorbing or complexing ability. Suitable examples include imidazoles, benzotriazoles, 1,2,3-triazoles, 1,2,4-triazoles, tri—, tetra- and penta-tetrazaiidenes, oxazoles, thiazoles, selenazoles, oxadiazoles, thiadiazoles, tetrazoles, pyridines, purines and pyrimidines. Triazoles, tetrazoles and benzotritzoles are particularly preferred.

A compound represented by Formula IIIb is a five or six membered heterocyclic ring containing at least one, or more preferably two heteroatoms such as nitrogen or sulfur and also containing at least one —S—H bond. These compounds can be optionally benzo or naptho condensed and further substituted with additional groups such as ethers, thioethers, halide atoms, cyano, sulfonyl and the like to manipulate the silver emulsion absorbing or complexing ability. Suitable examples are sulfur substituted imidazoles, benzotriazoles, 1,2,3-triazoles, 1,2,4-triazoles, tri-, tetra- and penta-tetrazaiidenes, oxazoles, thiazoles, selenazoles, oxadiazoles, thiadiazoles, tetrazoles, pyridines, purines and pyrimidines. Particularly preferred are mercapotetrazoles and mercaptotriazoles.

A compound represented by Formula IIIc is a thiocarbonyl derivative where Q is oxygen, sulfur, substituted or unsubstituted nitrogen and Z is an ether, thioetier or amino group. Q and Z nmay optionally be connected with the necessary atoms to form a ring system. Suitable examples are thioanmides and thioureas.

The following are representative examples of groups, which may contain further substitutents, suitable as A in Formula I according to Formulas IIIa to IIIc:

Formula IIIa:

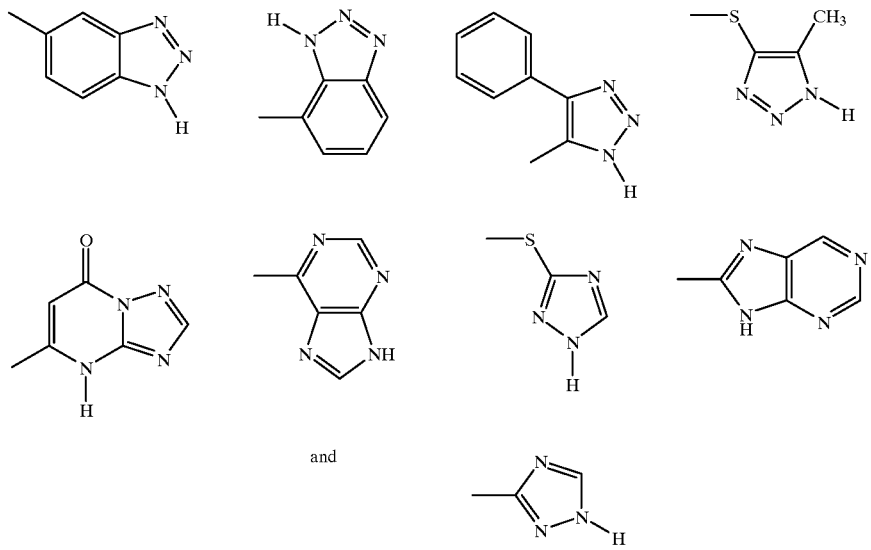

Formula IIIb:

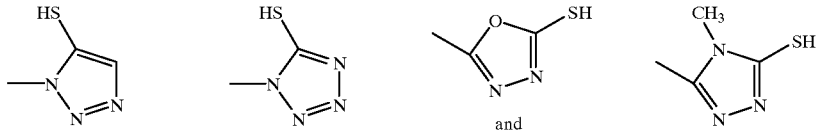

Formula IIIc:

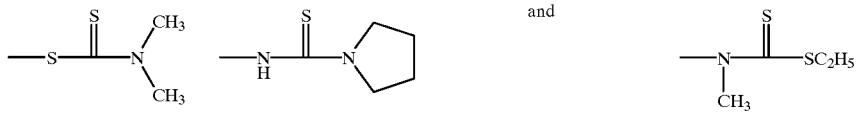

The most preferred A groups of the IEC of Formula I are those of Formula IIIa.

An important feature of the IECs of Formula I is their oil/water partition coefficient Lower numbers reflect greater water solubility and higher numbers reflect greater oil solubility. The oil/water partition coefficient can be calculated using Medchem Version 3.54 to predict this value as ClogP. This is a software program produced by the Medicinal Chemistry Project, Pomona College, Pomona, Calif. In order to maximize the i nterimage effect, the water solubility cannot be so low that the coupler is unable to interact effectively with the silver surface. Thus, it is preferred that the ClogP of the IEC is not greater than 20 and most preferred that the ClogP is not greater than 17. However, the water solubility cannot be too great or the compound becomes an effective inhibitor of silver development (causing a loss in sensitivity) or may wander into other layers causing ill effects. Thus, it is more preferred that the ClogP of the IEC be at least 6.25 or most preferably at least 7.

It should be noted that not all suructures will calculate directly as drawn in the Medchem program if one or more functional groups are not in the database. It may be necessary to use alternati ve proton tautomers. For example, IEC-A is not in the database when drawn as a 5-pyrazolone but is in the data base when drawn in its enoLic form as a 5-hydroxyilmidiazole. Another example that is not present in the data base is IEC-D. In cases like this, the ClogP was determined by analogy with its isomeric pyrazolotriazole (for example, the same nucleus as in IEC-C) which does calculate. In other cases, it may be necessary to estimate changes relative to acyclic or alternatively substituted systems that are in the data base. For example, in IEC-F the contribution of the oxazolidinedione ring was estimated by replacing its carbamate oxygen with a methylene group, followed by a correction derived from the calculated difference between a carbamate oxygen and a methylene group in the corresponding acyclic analogs. Of course it is also an alternative to determine the log using conventional wet experimentation to determine the partition coefficient.

It should be noted that the Medchem program does not predict the effect of ionization. If the IEC contains an ionizable group, then the actual oil/water partition coefficient may be lower (more water soluble) than that otherwise predicted. The use of ClogP as calculated by Medchem is solely for the purpose of ranking fully protonated couplers by structure and performance.

The laydown of the IEC compounds of Formula I is important to obtain the desired effect. In general, the molar ratio of IEC compound to silver should be at least $1\times10^{-3}$ and more preferably, at least $5\times10^{-3}$.

The following are examples of IEC compounds of Formula I that are useful in this invention, along with the corresponding ClogP values:

IEC-A:

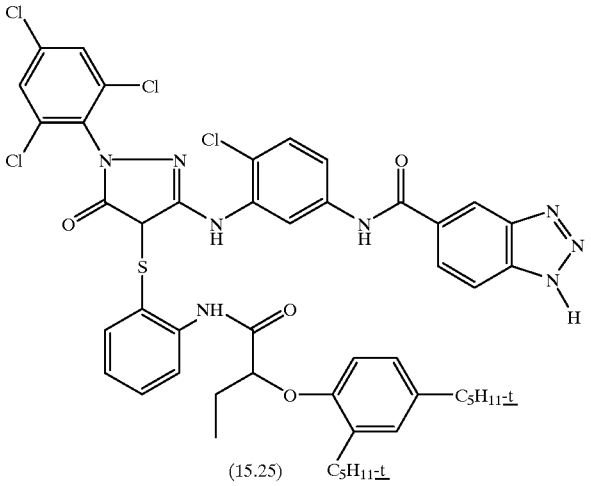

(15.25)

IEC-B:

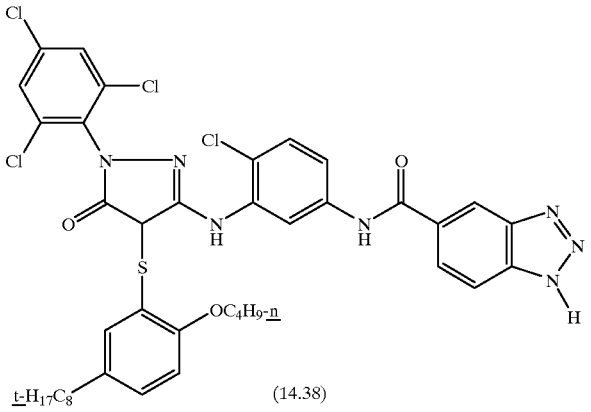

(14.38)

-continued
IEC-C:
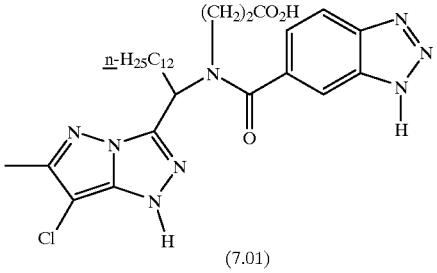
(7.01)
IEC-D:
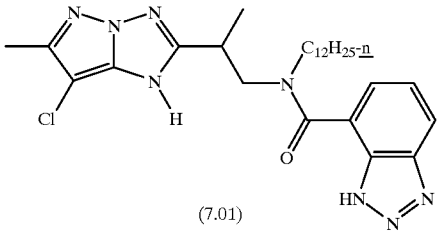
(7.01)
IEC-E:
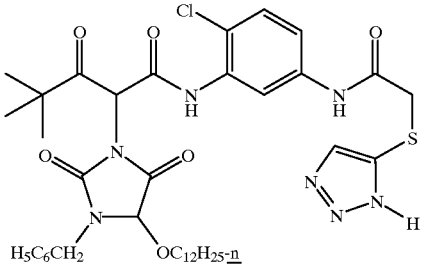
IEC-F:
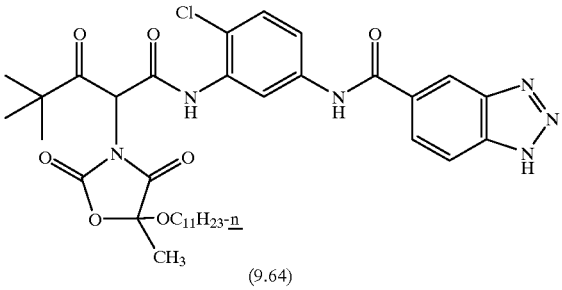
(9.64)
IEC-G:
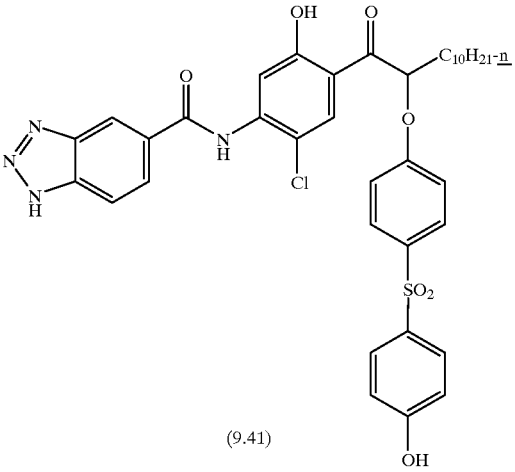
(9.41)

-continued
IEC-H:
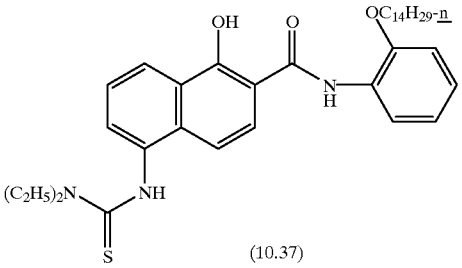
(10.37)
IEC-I:
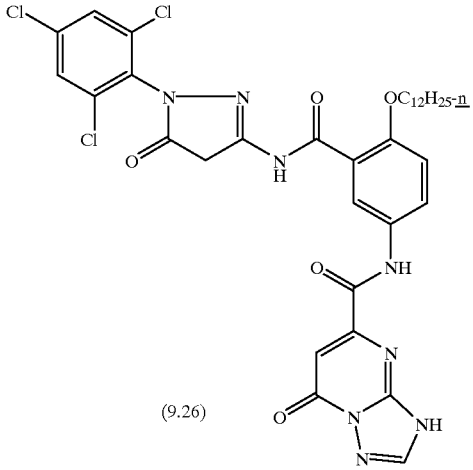
(9.26)
IEC-J:
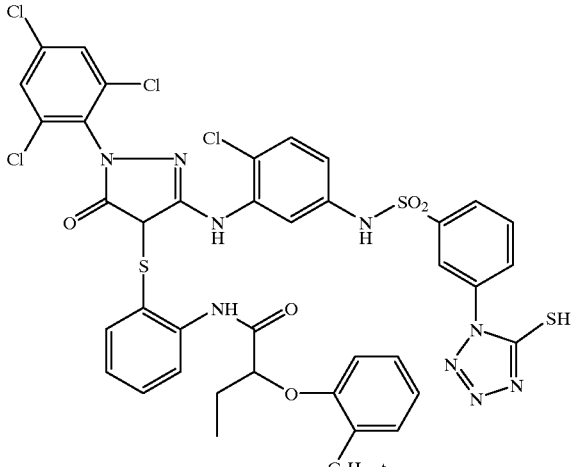
(13.00)

-continued
IEC-K:
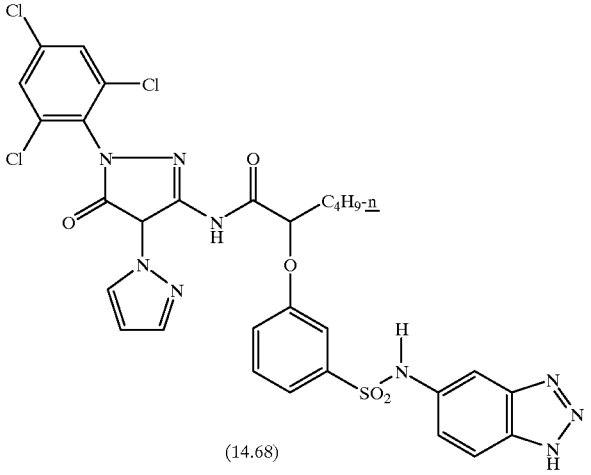
(14.68)
IEC-L:
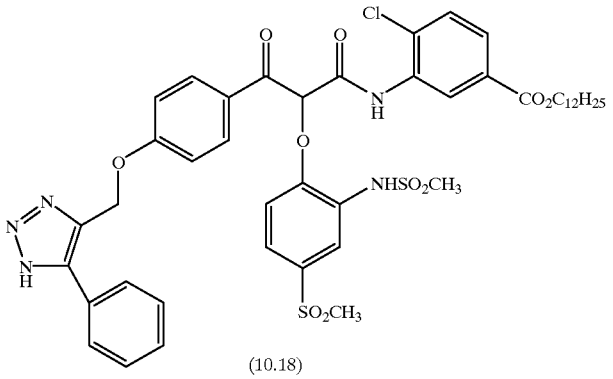
(10.18)
IEC-M:
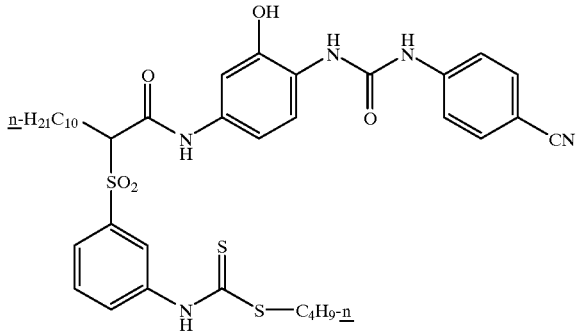
(8.71)

-continued
IEC-N:
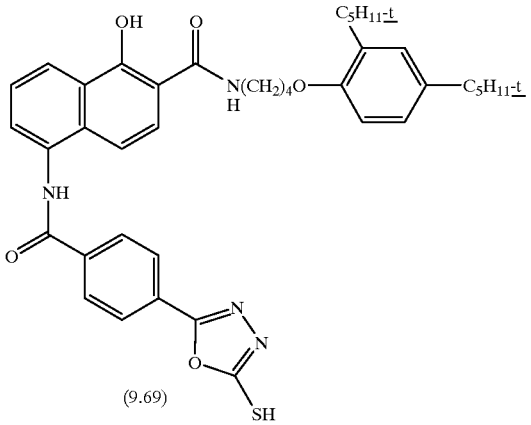
(9.69)
IEC-O:
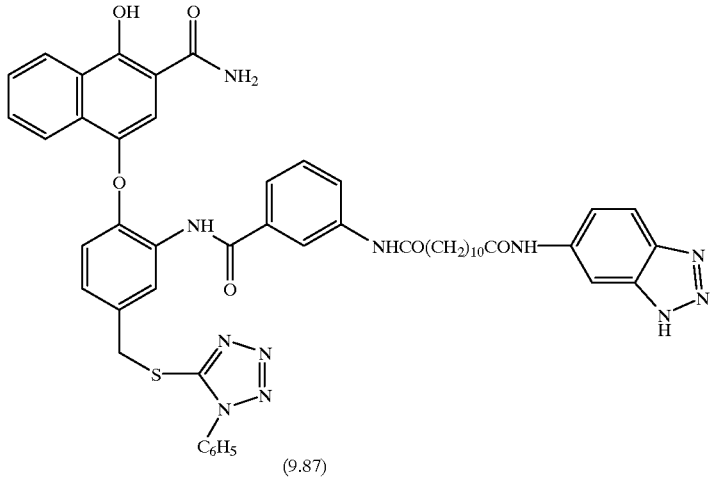
(9.87)
IEC-P:
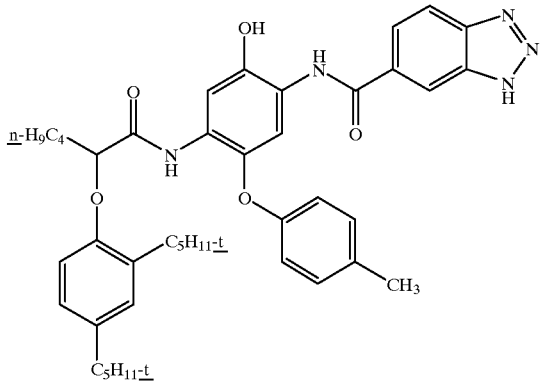
(10.74)

-continued

IEC-Q:

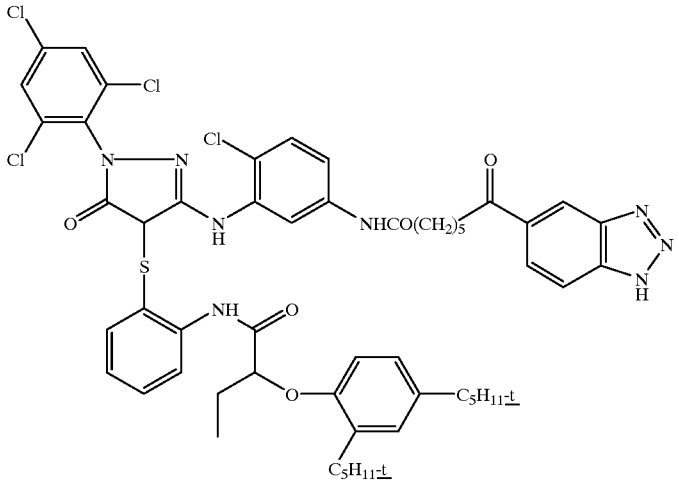

(16.78)

IEC-R:

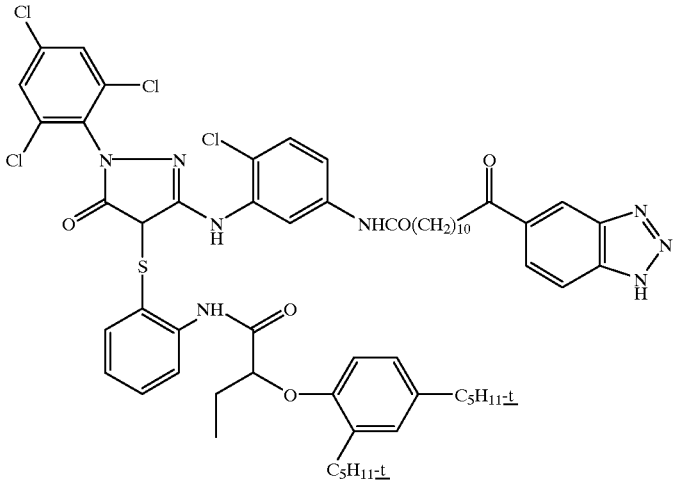

(19.42)

IEC-S:

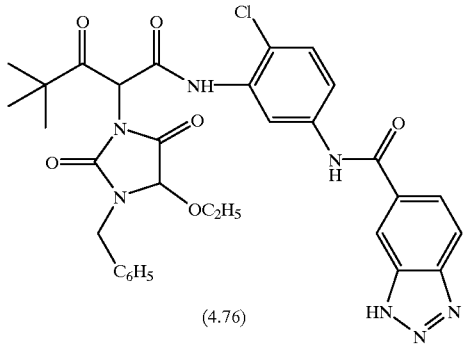

(4.76)

The couplers of Formula II are well known in the art The inhibitor fragment may be released directly (a DIR) or may be anchimerically released indirectly through the use of a timing group (a DI(A)R) as known in the art. As more fully described hereinafter, Time is a group released from $COUP_2$ with INH attached which instantly or with a time delay, then releases INH, an inhibitor fragment. The inhibitor fragment can be any of those that are normally relatively weak or mild in their ability to cause silver inhibition. If the fragments are mild inhibitors, then they would typically not cause much inhibition in either the layer in which they are released or in other layers. However, the IECs of Formula I greatly increase the sensitivity to inhibition by these mild inhibitors in the layer in which the IEC is located. This allows for greater Interimage effects in one specific layer relative to another, even if both receive the same amount of mild inhibitor fragment from the originating layer and without over-inhibition of the causing layer. This is accomplished by the locating the IEC in the receiving layer where increased inhibition is desired and the DIR coupler that releases the mild inhibitor in the interimage causing layer. The IECs do not significantly alter the inhibition of their layer by strong inhibitors which might be released through other compounds; thus, strong inhibitors can be used in combination with the mild inhibitors of the invention simultaneously. The most desirable mild inhibitors are those that bear hydrolyzable groups; that is, groups such as esters that hydrolyze in the high pH of the developer. This helps prevent mild inhibitors from diffusing from the film and contaminating the developer solution. The rate of hydrolysis of the mild inhibitor in the developer is important; desirably, the half-life should be longer than 5 minutes in order to remain an effective inhibitor during development, but should be less than 24 hours in order to avoid seasoning effects.

The mild inhibitor fragments that are used in this invention are defined as those that cause less than a 45% gamma reduction, or more preferably less than a 40% gamma reduction, relative to a non-inhibitor containing check when coated as the following single layer film element on a cellulose triacetate film support (coverages are in g/m$^2$):

Overcoat Gelatin at 2.79 and 0.02 bis-vinylsulfonemethylether

Imaging Layer Gelatin at 2.79 Magenta Image Coupler M-1 as described in the photographic examples (dispersed at 80% by weight in tricresyl phosphate and 20% by weight N,N-dilutyl-2-butoxy-5-t-octylaniline) at 0.692 DIR being tested at 0.055 mmol/m$^2$ (dispersed in twice its weight in N,N-dibutyllauramide)

Green sensitized AgBrI at 1.08

Samples of each element were given a stepped exposure and processed in the KODAK FLEXICOLOR™(C-41) process as described in *British Journal of Photography Annual*, 1988, pp 196–198. Contrast of the elements was determined using the maximum slope between any two density points.

TABLE I

Examples of Mild and Strong DI(A)Rs.

| Sample | DI(A)R | % Contrast Reduction |
|---|---|---|
| SL-1 | CDIR-1 | −55.4% |
| SL-2 | CDIR-2 | −67.1% |
| SL-3 | CDIR-3 | −75.7% |
| SL-4 | CDIR-4 | −77.1% |
| SL-5 | CDIR-5 | −70.5% |
| SL-6 | CDIR-6 | −75.4% |
| SL-7 | CDIR-7 | −63.9% |
| SL-8 | CDIR-8 | −49.2% |
| SL-9 | CDIR-9 | −50.1% |
| SL-10 | CDIR-10 | −53.8% |
| SL-11 | CDIR-11 | −58.6% |
| SL-12 | IDIR-1 | −34.5% |
| SL-13 | IDIR-2 | −25.3% |
| SL-14 | IDIR-3 | −24.5% |
| SL-15 | IDIR-4 | −22.6% |
| SL-16 | IDIR-5 | −42.0% |
| SL-17 | IDIR-6 | −24.9% |
| SL-18 | IDIR-7 | −20.0% |
| SL-19 | IDIR-8 | −2.4% |

The following are comparative strong DI(A)R couplers used in TABLE I

CDIR-1:

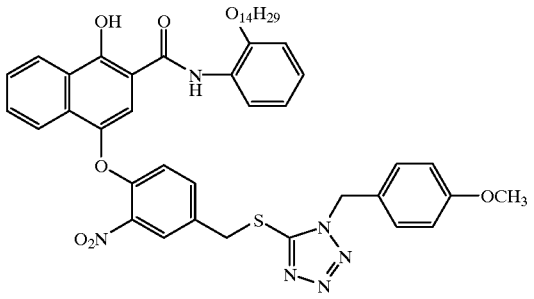

CDIR-2:

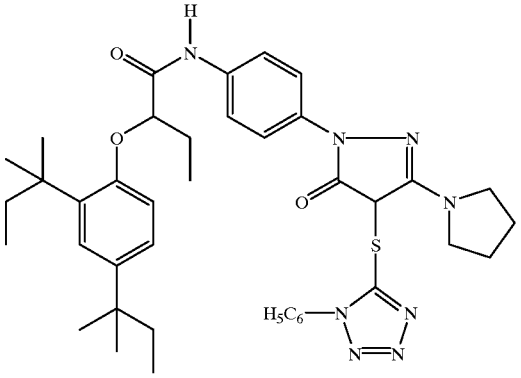

CDIR-3:

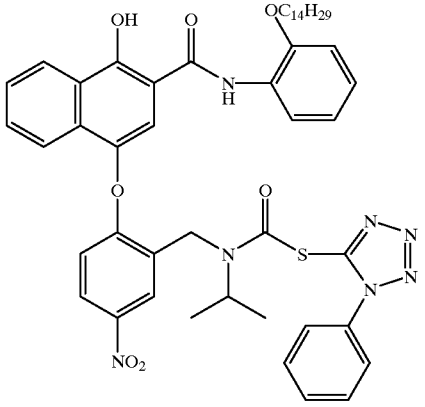

-continued

CDIR-4:

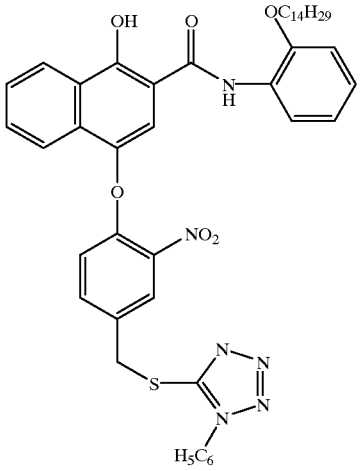

CDIR-5:

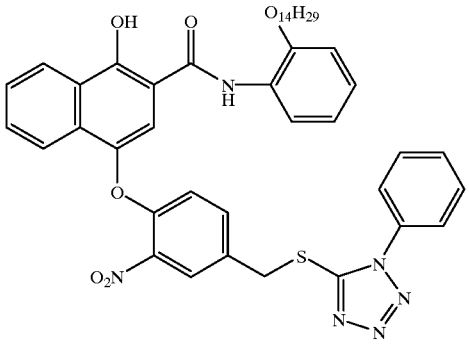

CDIR-6:

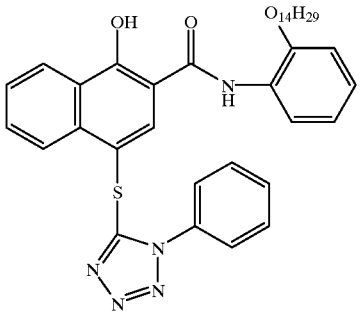

CDIR-7:

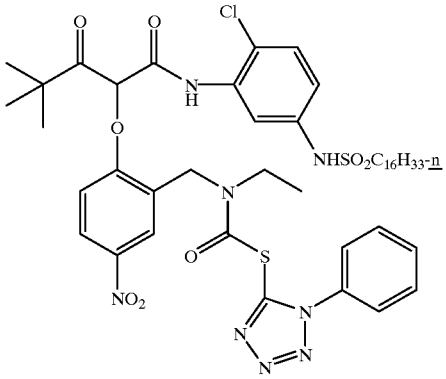

-continued

CDIR-8:

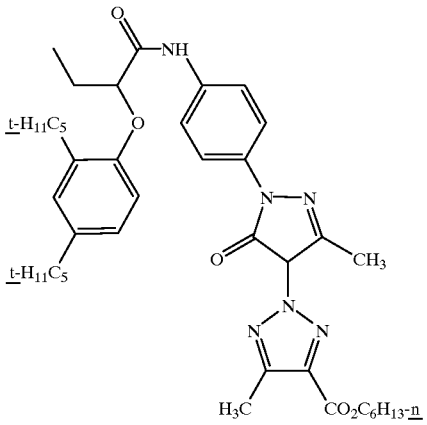

CDIR-9:

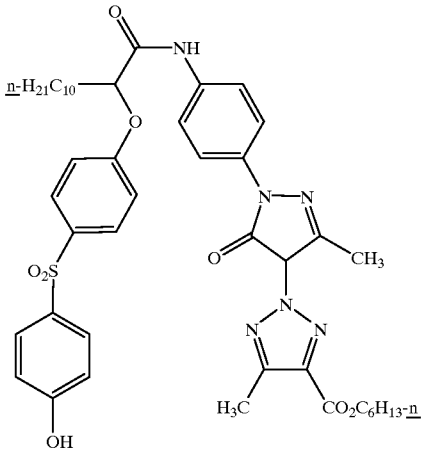

CDIR-10:

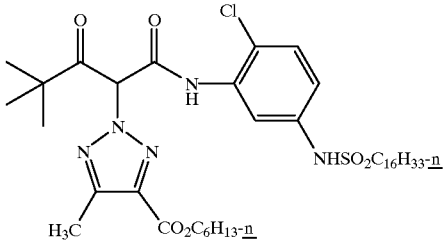

CDIR-11:

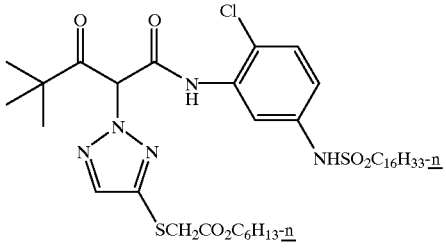

Specific examples of strong inhibitor fragments that are not part of this invention are phenylmercaptotetrazole, p-methoxybenylmercaptotetrazole, tetrabromobenzotriazole, 4-methyl-5-carboxyhexyl-1,2,3-triazole and 6-(hexyl thioacetyl-1,2,3-triazole.

The following are examples of mid DIRs shown in Table I that are useful in this invention:

IDIR-1:
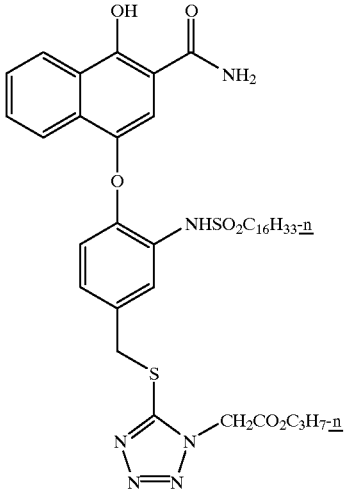
IDIR-2:
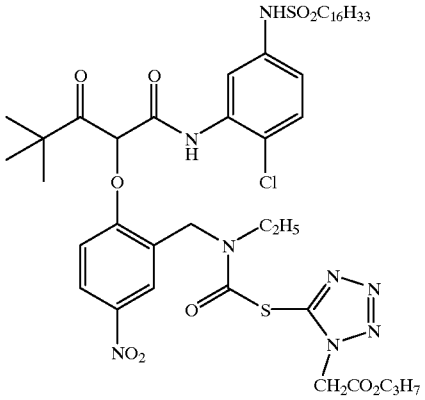
IDIR-3:
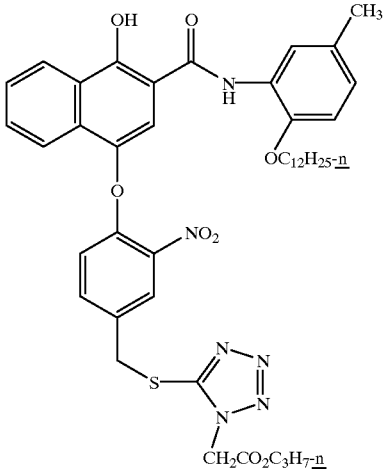
-continued
IDIR-4:
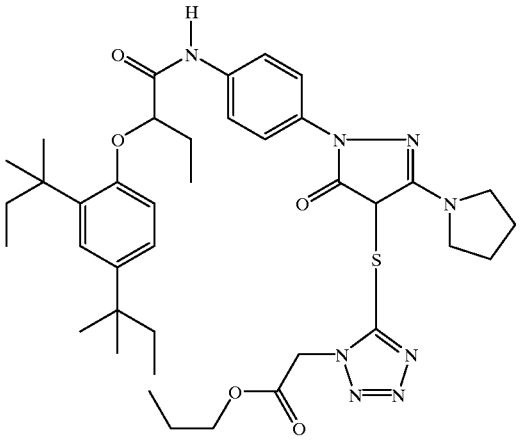
IDIR-5:
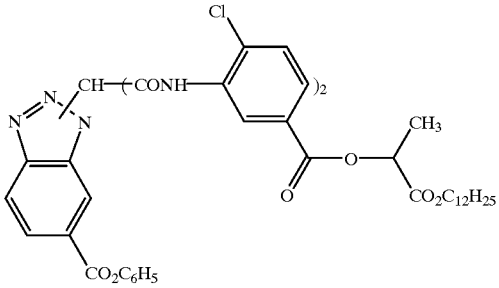
IDIR-6:
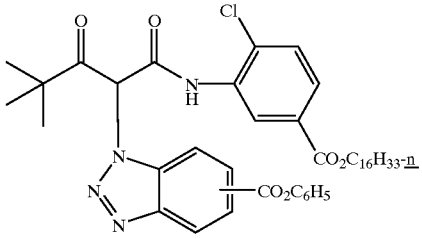
IDIR-7:
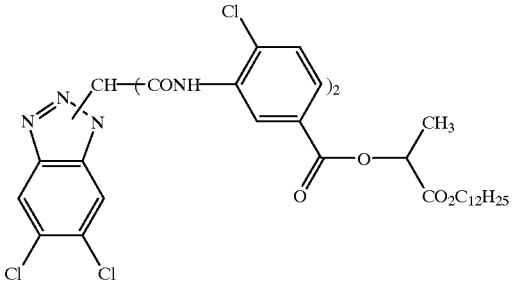
IDIR-8:
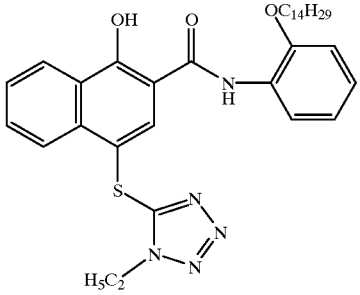

The following are additional examples of mild inhibitor fragments (INH in Formula II) useful in the invention:

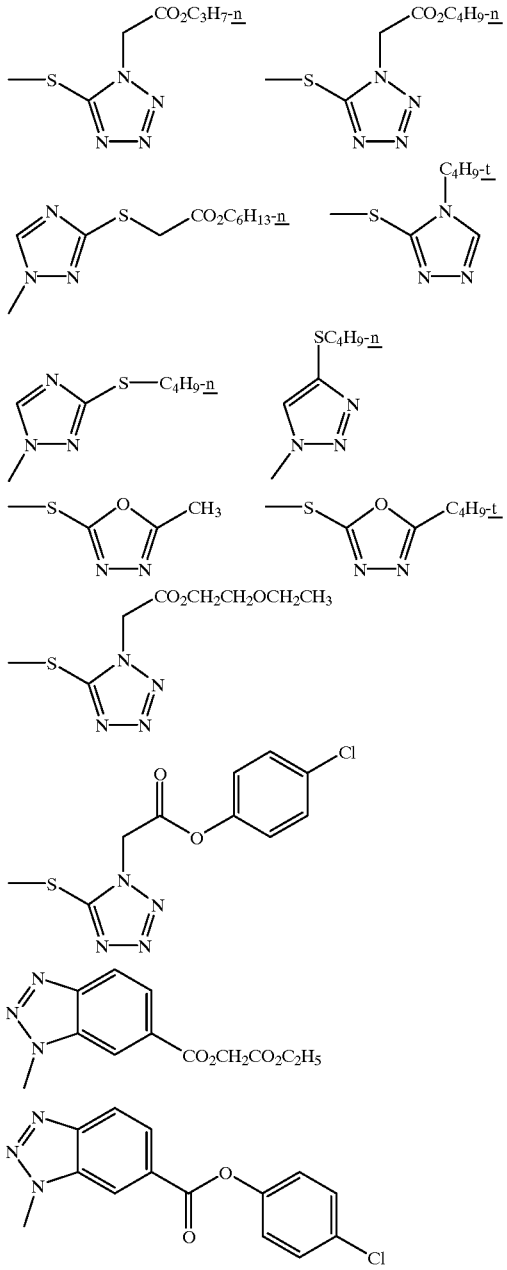

The more preferred inhibitor fragments are mercaptotetrroles and benzotriazoles that contain a hydrolyzable group such as those discussed previously.

The materials of the invention can be added to a solution containing silver halide before coating or be mixed with the silver halide just prior to or during coating. In either case, additional components like couplers, doctors, surfactants, hardeners and other materials that are typically present in such solutions may also be present at the same time. The materials of the invention are not water soluble and cannot be added directly to the solution. They may be added directly if dissolved in an organic water miscible solution much as methanol acetone or the like or more preferably as a dispersion. A dispersion incorporates the material in a stable, finely divided state in a hydrophobic organic solvent that is stabilized by suitable surfactants and surface active agents usually in combination with a binder or matrix such as gelatin. The dispersion may contain one or more permanent coupler solvent that dissolves the material and maintains it in a liquid state. Some examples of suitable permanent coupler solven-is are tricresylphosphate, N,N-diethyllauramide, N,N'-dibutyliauramide, p-dodecylphenol, dibutylpthalate, di-n-butyl sebacate, N-n-butylacetanilide, 9-octadec-en-1-ol, trioctylamine and 2-ethylhexylphosphate. The dispersion may require an auxiliary coupler solvent to initially dissolve the component but is removed afterwards, usually either by evaporation or by washing with additional water. Some examples of suitable auxiliary coupler solvents are ethyl acetate, cyclohexanone and 2-(2-butoxyethoxy)ethyl acetate. The dispersion may also be stabilized by addition of polymeric materials to form stable latexes. Examples of suitable polymers for this use generally contain water solubilizing groups or have regions of high hydrophilicity. Some examples of suitable dispersing agents or surfactants are Alkanol XC or saponin. The materials of the invention may also be dispersed as an admixture with another component of the system such as a coupler or a oxidized developer scavenger so that both are present in the same oil droplet.

Throughout this specification, unless otherwise specifically stated, when a substituent group contains a substitutable hydrogen, it is intended to encompass not only the substituent's unsubstiiuted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogerl, such as chlorine, bromine or fluorine; nitro; hydroxyl; cyano; carboxyl; or groups which may be further substituted, such as alkyl, including straight (ir branched chain or cyclic alkyl, such as methyl, trifluoromethyl, ethyl, t-butyl, 3-(2,4di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alphia-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succininido, N-phthlimido, 2,5-dioxo-1-oxazolidinyl, 3-dodecyl-2,5-dioxo-1-imidazolyl, and N-acetyl-N-dodecylamino, ethoxycarbonylamino, phenoxycarbonylarnino, benzyloxycarbonylamino, hexadecyloxycarbonylamino, 2,4di-t-butylphenoxycarbonylamino, phenylcarbonylamino, 2,5-(di-t-pentylphenyl)c arbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-ciphenylureido, N-phenyl-N-p-tolylureido, N-(m-hexadecylphenyl)ureido, N,N-(2,5-di-t-pentylphenyl)-N'-ethylureido, and t-butylcarbonamido; sulfonaniido, such as methylsulfonamido, benzenesulfonamido, p-tolylsulfonamido, p-dodecylbenzenesulfonamido, N-methyltetradecylsulfonamido, N,N-dipropylsilfamoylarnino, and hexadecylsulfonamido; sulfamoyl, such as N-riethylsulfamoyl, N-ethylsulfamoyl, N,N-dipropylsulfamoyl, N-hexadecylsulfamoyl, N,N-dirnethylsulfamoyl; N-[3-(dodecyloxy)propyl]sulfamoyl, N-[4-(2,4di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy) butyl]carbamoyl, N-methyl-N-tetradecylcarbamoyl, and N,N-dioctylcarbamoyl; acyl, such as acetyl, (2,4di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4di-t-pentylph noxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylarnine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of venous components, it may be desirable to include a high molecular weight or polymeric backbone containing hydrophobic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silvers halide emulsion layer having associated there with at least one cyan dye-forming coupler, a magenta dye image-forming unit (comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instruction as (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including cipersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocycle, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305; 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480. 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016. 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93102392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobemzimidazoles that form magenta dyts upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp.112–126 (1961); as well as U.S. Pat. Nos. 2,298,443; 2,407,210; 2,875,057; 3,048,194; 3,265,506; 3,447,928; 4,022,620; .1,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers de not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in i—,P 213.490; Japanese Published Application 58-172,647; U.S. Pat. Nos. 2,83,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching- or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097, 140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543, 323.) Also, the compositions may be blocked or coaled in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful In conjunction with the compositions of the invention are known in the art and examples are described in U.S. Pat. No. Nos. 3,137,578; 3,148,022; 3,148, 062; 3,227.554; 3,384,657; 3,379,529; 3,615,506; 3,617, 291; 3,620,746; 3,701,783; 3,733,201; 4,049,455; 4,095, 984; 4,126,459; 4,149,886; 4,150,228; 4,211,562; 4,248, 962; 4,259,437; 4,362,878; 4,409,323; 4,477,563; 4,782, 012; 4,962,018: 4,500,634; 4,579,816; 4,607,004; 4,618, 571; 4,678,739; 4,746,600; 4,746,601; 4,791,049; 4,857, 447; 4,865,959; 4,880,342; 4,886,736; 4,937,179; 4,946, 767; 4,948,716; 4,952,485; 4,956,269; 4,959,299; 4,966, 835; 4,985,336 as well as in patent publications GB 1,560, 240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,411; 346, 899; 362, 870; 365,252; 365, 346; 373,382; 376,212; 377,463; 378,236; 384,670; 396, 486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mere aptotriazoles, mercaptooxadiazoles, mercaptodiazoles, mercaptooxathiazoles, tclleaurotetrazoles or benzisodiazoles. In a preferred embodiment, the inhibitor moiety or group is selected from the following formulas:

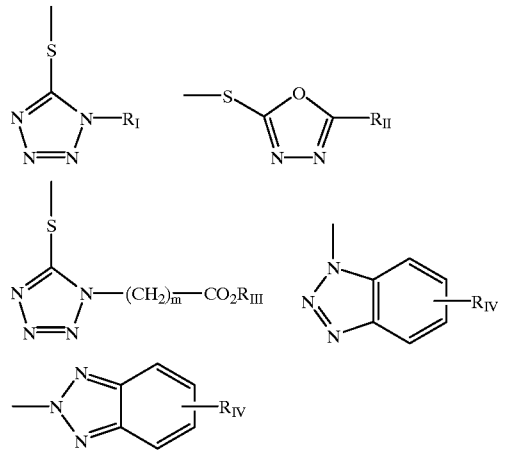

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the liming group is of one of the formulas:

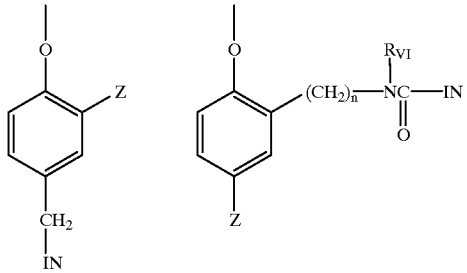

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Aside from the compound of Formula II of the invention, suitable developer inhibitor-releasing couplers that may be included in photographic light sensitive emulsion layer include, but are not limited to, the following:

D1

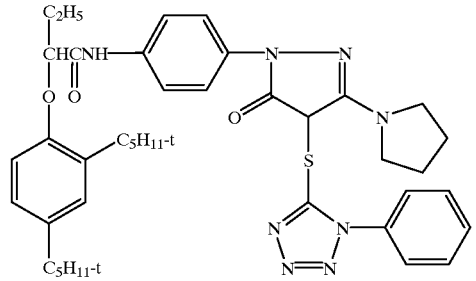

D2

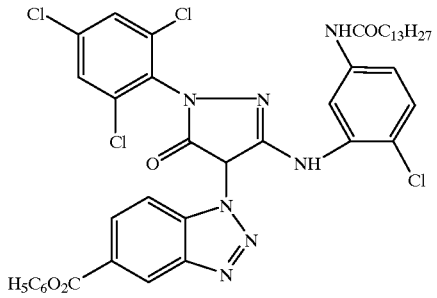

D3

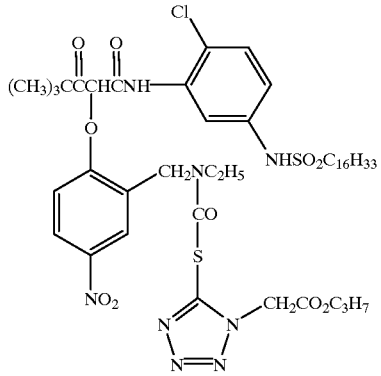

D4

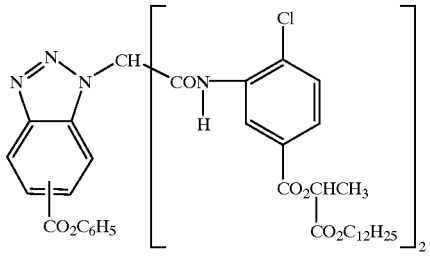

D5

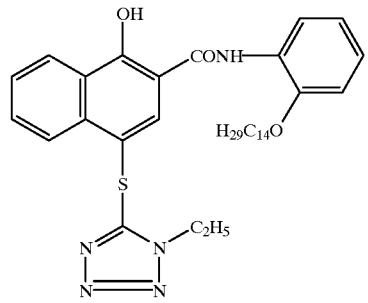

-continued
D6
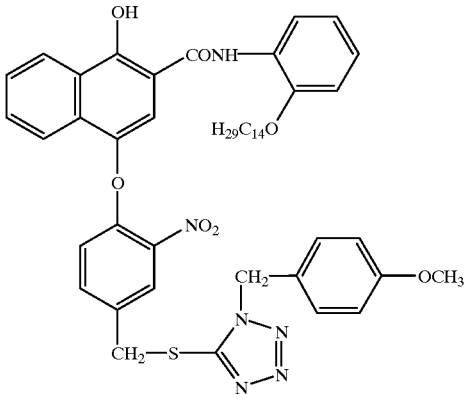
D7
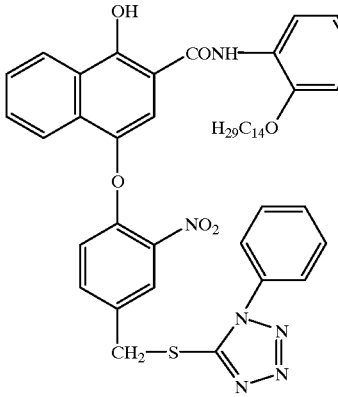
D8
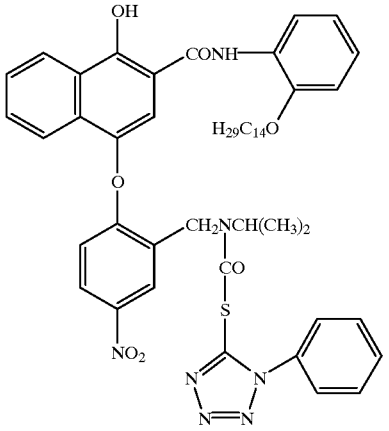
-continued
D9
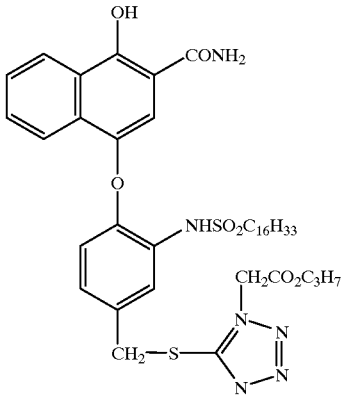
D10
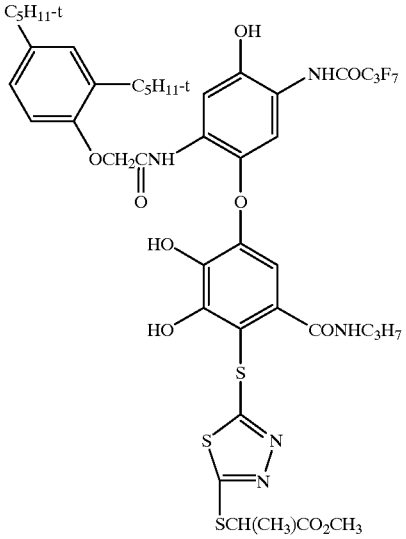
D11
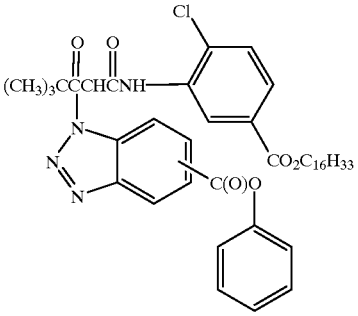

-continued

D12

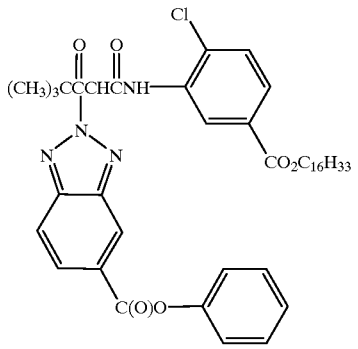

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of total grain projected area. Preferred tabular grain emulsions are those in which the average thickness of the tabular grains is less than 0.3 micrometer (preferably thin—that is, less than 0.2 micrometer and most preferably ultra thin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form, tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultra thin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultra thin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultra thin high chloride {100} tabular grain eniulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing, to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal c f Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydrox) ethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patent applications, patents and other publications referred to in this specification are incorporated herein by reference.

Synthesis

The couplers useful in the invention may be prepared in any desirable manner such as those shown in Research Disclosure. The synthesis of IEC-A is shown in the following Scheme I as follows:

Scheme I:

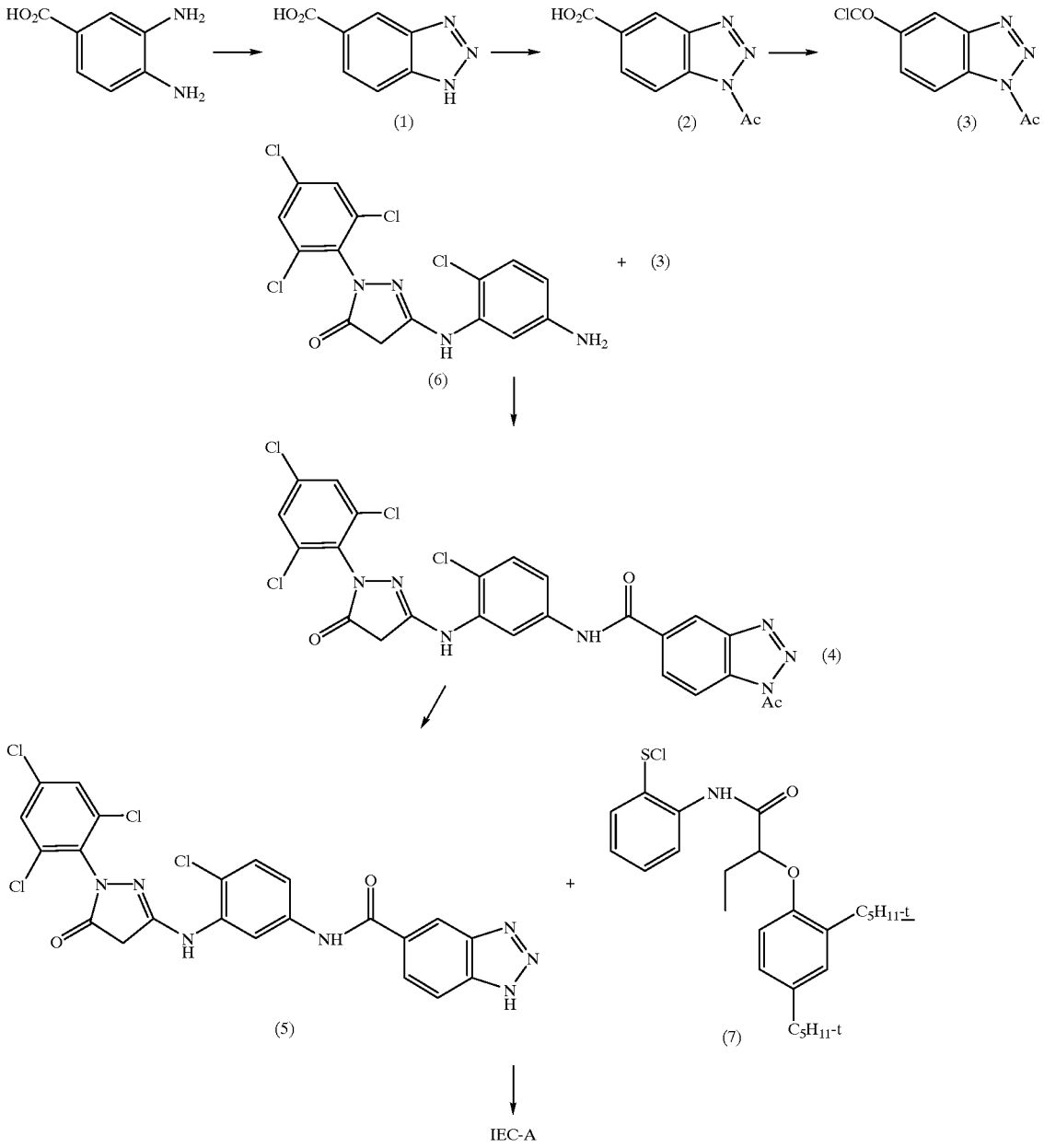

Preparation of IEC-A

Preparation of Compound 1:

3,4-Diaminobenzoic acid (30.4 g, 0.2 mol) and glacial acetic acid (650 ml) were heated on a steam-bath until the solid had dissolved. The solution was then cooled to 10° C. in an ice-bath and a solution of sodium nitrite (13.8 g, 0.2 mol) in water (100 ml) was added over 1 hour keeping the temperature at 11–16° C. The mixture was then stirred at ambient temperature for 3 hours before the resulting beige solid was filtered off and allowed to dry in air, 42.4 g. This weight of product is greater than the theoretical yield due to the presence of acetic acid.

Preparation of Compound 2:

Compound 1, wet with glacial acetic acid (42.3 g, ca 0.2 mol) and acetic anhydride (150 ml, 1.59 mol) were stirred and heated under reflux in an oil-bath at 135–160° C. for 7 hours. The mixture was allowed to cool to room temperature and stand for 18 hours before the resulting cream solid was filtered off, and washed first with acetic anhydride, then with diethyl ether and dried, 30.9 g (ca 75%)

Expected C, 52.68; H, 3.44; N, 20.49; Found C, 52.69; H, 3.34; N, 20.42%.

Preparation of Compound 3:

Compound 2 (10.25 g, 0.05 mol) and thionyl chloride (100 ml) were heated under reflux on a steam-bath for 25 minutes. The resulting solution was allowed to cool to room temperature then it was concentrated under reduced pressure to give a cream solid, 11.06 g (98%)

Preparation of Compound 4:

Pyridine (25 ml) was added to a stirred suspension of Compound 6 (47.3 g, 0.117 mol) in THF (500 ml), a dark brown solution resulted. A solution of Compound 3 (27.1 g, 0.121 mol) in THF (200 ml) was added dropwise with stirring to the brown solution. The temperature rose to 30° C. The reaction mixture was stirred at room temperature for 2 hours. Pyridine (80 ml) was added and the reaction mixture stirred at room temperature for a further 72 hours. The reaction mixture was poured into 10% hydrochloric acid. A dark gum separated which then hardened. The aqueous solution was decanted off and the residue boiled in ethyl acetate (21). On cooling the beige colored solid was collected by filtration to give 55.0 g (80%)

Preparation of Compound 5:

Potassium hydroxide (11.25 g, 0.2 mol) in methanol (150 ml) was added dropwise to a stirred suspension of Compound 4 (53.8 g, 0.091 mol) in methanol (450 ml). A dark brown solution formed. The reaction mixture was stirred at room temperature of 2 hours. Glacial acetic acid (12 ml) was added dropwise to the reaction mixture, a brownish precipitate was formed. After stirring at room temperature for 0.5 hour, the precipitate was collected by filtration. The residue was washed with methanol and dried to give the product as a light brown solid, 43.18 g (86%).

Preparation of IEC-A a) Preparation of Compound 7

A solution of sulphuryl chloride (3.0 g, 0.022 mol) in dichloromethane (10 ml) was added dropwise to a stirred solution of N,N'-(dithiodi-2,1-phenylene)bis[2-[2,4-bis(1,1-dimethylpropyl) phenoxy]-butananide (17.0 g, 0.02 mol) in dichloromethane (65 ml). The solution was stirred at room temperature for 1.5 hours and then concentrated to dryness on a rotary evaporator to give the sulphenyl chloride as orange-yellow oil.

b) Reaction of Compound 7 with Compound 5

The sulphenyl chloride was dissolved in DMF (25 ml) and the solution added dropwise over 15 minutes to a stirred solution of Compound 5 (22.0 g, 0.04 mol) in DMF (65 ml). The reaction mixture was stirred at room temperature overnight and then poured into 10% hydrochloric acid (1.25l) and stirring continued for 15 minutes. The precipitate was collected by filtration and washed well with water and dried to give a light grey coloured solid. 42.0 g. Ethyl acetate (200 ml) was added to the solid, a dark brown solution resulted. The solution was heated on a steam-bath and at reflux a heavy precipitate was formed. The suspension was allowed to cool and the solid collected by filtration to give product as an off-white coloured solid, 31.75 g (81%).

Expected C, 59.14; H, 4.96; Cl, 14.55; N, 11.50; S, 3.29; Found C, 59.38, H, 4.89; Cl, 14.20; N, 11.56; S, 3.19%.

Photographic Examples

Bilayer photographic elements were prepared by coating the following layers on a cellulose triacetate film support (coverages are in g/m$^2$). Unless otherwise noted, all comparative and inventive compounds were dispersed in twice their own weight of N,N-dibutyllauramide:

Layer 1 (Antihalation Layer): black colloidal silver at 0.34 and gelatin at 2.41.

Layer 2 (Receiver Layer): gelatin at 2.79, CDIR-2 at 0.03 and 0.81 green sensitized AgIBr tabular emulsion with either:

Format A—Coupler or IEC added at 0.430 mmol/m$^2$

Format B—Coupler M-1 (dispersed as described previously) added at 0.45 and comparative compound (CIEC) or IEC added $7.2\times10^{-3}$ mmol/m$^2$ Layer 3 (Interlayer): gelatin at 0.64, ILS-1 at 0.11 and FD-1 at 0.11.

Layer 4 (Causer Layer): gelatin at 2.79, coupler Y-1 at 0.91, 0.79 blue sensitized AgIBr tabular emulsion and DIR at 0.11 mmol/m$^2$.

Layer 5 (Overcoat): gelatin at 2.79 and 0.02 bis-vinylsulfonemethylether

The structures of the couplers and comparative materials used, along with the corresponding ClogP where appropriate, in the above format are as follows:

M-1:
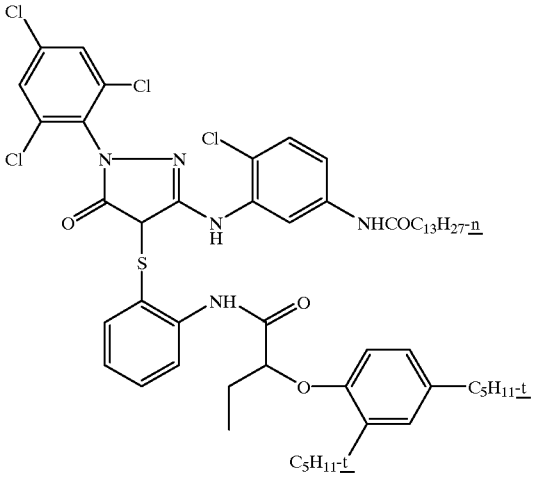
ILS-1:
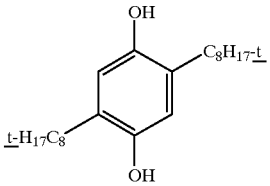
Y-1:
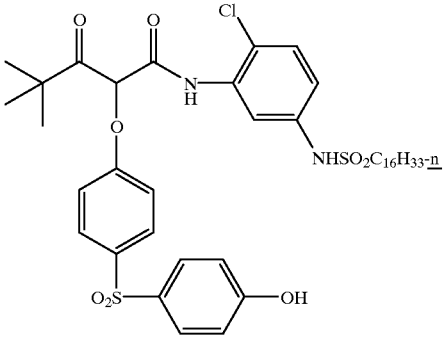
FD-1:
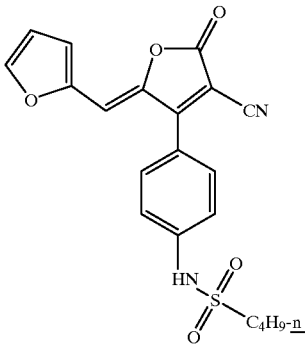

-continued
CIEC-1:
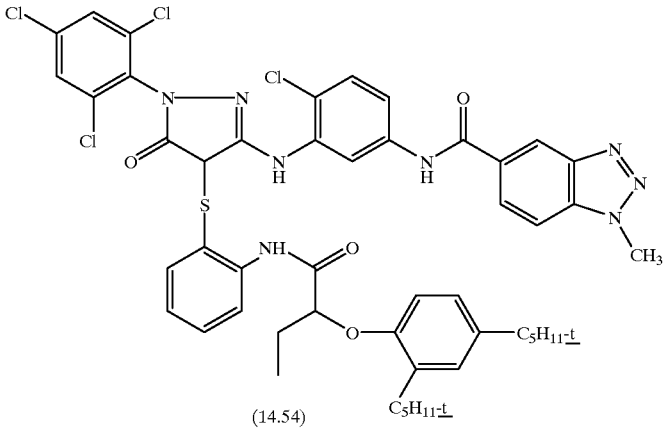
(14.54)
CIEC-2:
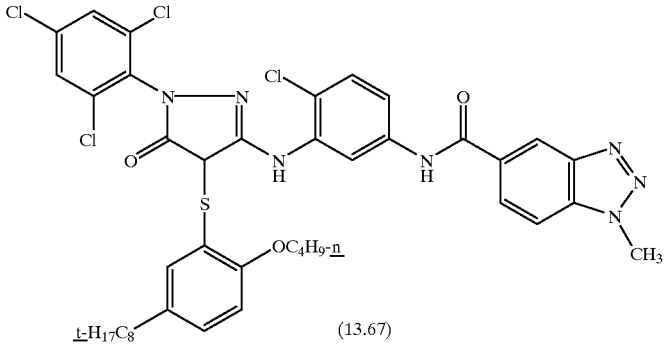
(13.67)
CIEC-3:
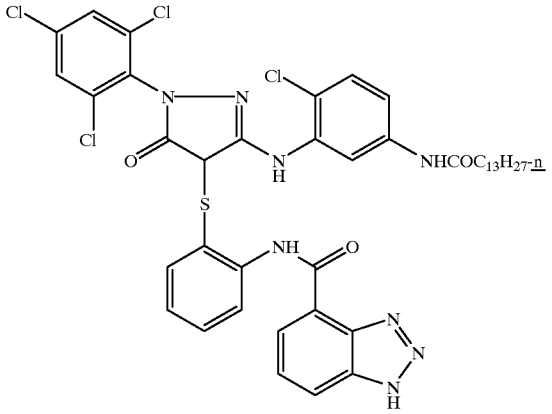
(13.31)
CIEC-4:
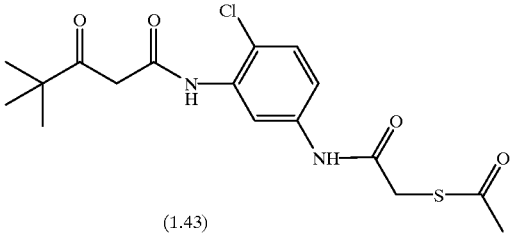
(1.43)

-continued

CIEC-5:

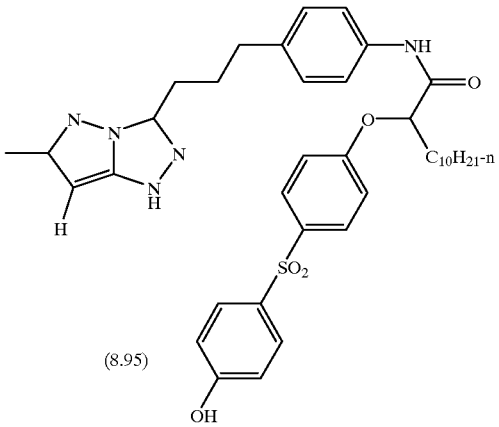

(8.95)

CIEC-6:

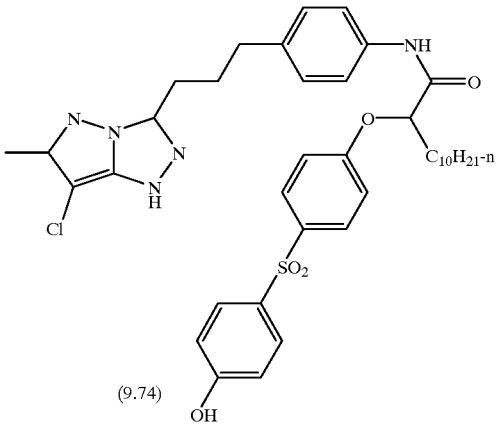

(9.74)

CIEC-7:

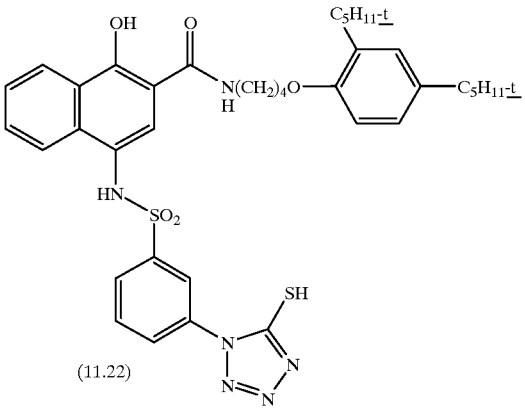

(11.22)

In the following examples, samples of each element were given a stepped exposure of either green light only or blue and green light combined and processed in the KODAK FLEXICOLOR (C-41) process as previously described. Contrast of the elements was determined using the maximum slope between any two density points. In this test, the ratio of the contrast of the green only exposure to the contrast of the green of a blue and green exposure ($C_g/C_{b+g}$) is a measure of the interimage. A higher ratio means more inhibition originating from the blue and affecting the green record. Relative green sensitivity, a measure of speed, was determined by measuring the speed point +0.15 density units above Dmin and normalizing to the check position. Results are shown in Table II.

TABLE II

Interimage in Bilayer Formats A and B (BL-A and BL-B)

| Sample | Comparative/ Inventive | DIR | Coupler in Layer 2 | Cg/Cb + g | Relative Green Sensitivity |
|---|---|---|---|---|---|
| BL-A-1 | C | CDIR-1 | A | 2.24 | 1.0 |
| BL-A-2 | C | CDIR-1 | IEC-A | 2.15 | 0.87 |

TABLE II-continued

Interimage in Bilayer Formats A and B (BL-A and BL-B)

| Sample | Comparative/ Inventive | DIR | Coupler in Layer 2 | Cg/Cb + g | Relative Green Sensitivity |
|---|---|---|---|---|---|
| BL-A-3 | C | IDIR-2 | A | 1.54 | 1.0 |
| BL-A-4 | I | IDIR-2 | IEC-A | 2.84 | 0.86 |
| BL-A-5 | C | IDIR-6 | A | 1.25 | 1.0 |
| BL-A-6 | I | IDIR-6 | IEC-A | 1.54 | 0.86 |
| BL-A-7 | C | IDIR-3 | A | 1.77 | 1.0 |
| BL-A-8 | I | IDIR-3 | IEC-A | 4.03 | 0.86 |
| BL-B-1 | C | IDIR-2 | — | 1.31 | 1.00 |
| BL-B-2 | C | " | CIEC-1 | 1.31 | 1.00 |
| BL-B-3 | C | " | CIEC-2 | 1.32 | 1.00 |
| BL-B-4 | C | " | CIEC-3 | 1.31 | 0.98 |
| BL-B-5 | C | " | CIEC-4 | 1.29 | 0.98 |
| BL-B-6 | C | " | CIEC-5 | 1.30 | 0.98 |
| BL-B-7 | C | " | CIEC-6 | 1.34 | 0.99 |
| BL-B-8 | C | " | CIEC-7 | 1.34 | 0.90 |
| BL-B-9 | I | IDIR-2 | IEC-A | 1.48 | 0.98 |
| BL-B-10 | I | " | IEC-B | 1.57 | 0.98 |
| BL-B-11 | I | " | IEC-F | 1.57 | 1.01 |
| BL-B-12 | I | " | IEC-G | 1.51 | 0.98 |

Comparison of examples BL-A-1 through BL-A-8 shows that the interimage improvement with the IEC of the invention occurs only in combination with the mild DIRs of the invention. Both the IEC and the mild DIR must be present. In particular, BL-A-2 (contains an IEC) does not show any improvement with CDIR-1, a strong DIR, over BL-A-1 (with no IEC). However, the presence of the IEC with a mild inhibitor of the invention as in BL-A-4, BL-A-6 and BL-A-8 does increase the interimage compared to the coatings without the IEC. In addition, only the IEC of the invention improves interimage in the presence of the mild DIR compounds as shown in examples BL-B-1 through BL-B-12, where the IEC is present with another image coupler. It is believed that, CIEC-1 and CIEC-2 have no N—H groups to be able to absorb to a silver emulsion; that CIEC-4 has no S—H group; and that CIEC-3 and CIEC-7 have the silver absorbable group attached through the coupling site. CIEC-5 and CIEC-6 are pyrazolotriazole couplers which do not fall within the definition of an IEC because the silver absorbable group (the pyrazolotriazole nucleus) is the coupling site as opposed to being attached to a separate non-coupling site as in an IEC of the invention.

Multilayer films demonstrating die principles of this invention were produced by coating the following layers on a cellulose triacetate film support (coverage are in grams per meter squared, emulsion sizes as determined by the disc centrifuge method and are reported in Diameter x Thickness in microns). Comparative examples are designated ML-C; inventive examples are designated ML-I.

Experimental Sample ML-C-0:

Layer 1 (Antihalation layer): black colloidal silver sol at 0.140; gelatin at 2.15; OxDS-1 at 0.108, DYE-1 at 0.049; DYE-2 at 0.017 and DYE-3 at 0.014.

Layer 2 (Slow cyan layer): a blend of three red sensitized (all with a mixture of RSD-1 and RSD-2) silver iodobromide emulsions: (i) a large sized tabular grain emulsion (1.3×0.118, 4.1 mole % I) at 0.522 (ii) a smaller tabular emulsion (0.85×0.115, 4.1 mole % I) at 0.337 and (iii) a very small tabular grain emulsion (0.55×0.115, 1.5 mole % I) at 0.559; gelatin at 2.85; cyan dye-forming coupler C-1 at 0.452; CDIR-1 at 0.043; bleach accelerator releasing coupler B-1 at 0.054 and anti-foggant 4-hydroxy-6-methyl-1,3,3a,7-tetraazaindene at 0.016.

Layer 3 (Fast cyan layer): a red-sensitized (same as above) tabular silver iodobromide emulsion (2.2×0.128, 4.1 mole % 1) at 0.086; cyan coupler C-1 at 0.081; CDIR-1 at 0.034; MC-1 at 0.043; gelatin at 1.72 and anti-foggant 4-hydroxy-6-methyl-1,3,3a,7-tetraazaindene at 0.010.

Layer 4 (Interlayer): gelatin at 1.29.

Layer 5 (Slow magenta layer): a blend of two green sensitized (both with a mixture of GSD-1 and GSD-2) silver iodobromide emulsions: (i) 0.54×0.091, 4.1 mole % iodide at 0.194 and (ii) 0.52×0.085, 1.5 mole % iodide at 0.559; magenta dye forming coupler M-1 at 0.24, gelatin at 1.08 and anti-foggant 4-hydroxy-6-methyl-1,3,3a,7-tetraazaindene at 0.005.

Layer 6 (Mid magenta layer): a blend of LOW green sensitized (same as above) tabular silver iodobromide emulsions (i) 1.3×0.113, 4.1 mole % I at 0.430 and (ii) 0.54×0.91, 4.1 mole % I at 0.172; magenta dye forming coupler M-1 at 0.065; MC-2 at 0.015; IDIR-5 at 0.016; gelatin at 2.12 and anti-foggant 4-hydroxy-6-methyl-1,3,3a,7-tetraazaindene at 0.003.

Layer 7 (Fast magenta layer): a green sensitized tabular silver iodobromide (1.8×0.127, 4.1 mole % I) emulsion at 0.689; gelatin at 1.61; magenta dye forming coupler M-1 at 0.043; MC-2 at 0.054 and CDIR-2 at 0.003.

Layer 8 (Yellow filter layer): gelatin at 0.86; Carey-Lea silver at 0.043 and OxDS-2 at 0.054.

Layer 9 (Slow yellow layer): an equal blend of three blue sensitized (both with YSD-1) silver iodobromide emulsions (i) 0.50×085, 1.5 mole % I tabular (ii) 0.60 diameter 3-D, 3% mole I and (iii) 0.68 diameter 3-D, 3 mole % I at a total of 0.430; yellow dye forming coupler Y-2 at 0.699; yellow dye forming coupler Y-3 at 0.215; IDIR-2 at 0.086; C-1 at 0.097 and gelalin at 2.066.

Layer 10 (Fast yellow layer): two blue sensitized (with YSD-1) silver iodobromide emulsions (i) 3.1×137, 4.1 mole % I tabular at 0.396 (ii) 0.95 diameter 3-D, 7.1 mole % I at 0.47; Y-2 at 0.131; Y-3 at 0.215; IDIR-2 at 0.075; C-1 at 0.011; B-1 at 0.008 and gelatin at 1.08.

Layer 11 (Protective overcoat and UV filter layer): gelatin at 1.61; silver bromide Lippman emulsion at 0.215; UV-1 and UV-2 (1:1 ratio) at a total of 0.023 and bis (vinylsulfonyl)methane hardener at 1.6% of total gelatin weight.

Surfactants, coating aids, emulsion addenda, sequestrants, lubricants, matte and tinting dyes were added to the appropriate layers as is common in the art. The following describes the composition of each particular experimental coating based on ML-C-0:

ML-C-1: In layer 3, CDIR-1 reduced to 0.017 and IDIR-8 added at 0.043.

ML-C-2: In layer 3, CDIR-1 reduced to 0.017 and IDIR-3 added at 0.060.

ML-C-3: In layer 9, IDIR-6 replaces IDIR-2 at 0.057 and in layer 10 at 0.50.

ML-C-4: In layer 5, CIEC-8 added at 0.067; in layers 6 and 7, CIEC-8 added at 0.022.

ML-C-5: Like ML-C-4 but in layer 3, CDIR-1 reduced to 0.017 and IDIR-3 added at 0.060.

ML-C-6: Like ML-C-3 but in layer 5, CIEC-8 added at 0.067; in layers 6 and 7, CIEC-8 added at 0.022.

ML-C-7: Like ML-C-6 but in layer 3, CDIR-1 reduced to 0.017 and I DIR-3 added at 0.060.

ML-C-8: In Layer 7, IDIR-5 added at 0.002; IDIR-6 replaces IDIR-2 at 0.067 in layer 9 and at 0.059 in layer 10.

ML-C-9: Like ML-C-8 but IDIR-1 replaces IDIR-5 in layer 7 at 0.003.

ML-C-10: In layer 5, IEC-A added at 0.00068, in layer 6 at 0.00044 and in layer 7 at 0.00062.

ML-I-0: Like ML-C-0, but in layer 5, IEC-A added at 0.064 and in layers 6 and 7, IEC-A added at 0.021.

ML-I-1: Like ML-C-1, but in layer 5, IEE-A added at 0.064 and in layers 6 and 7, IEC-A added at 0.021.

ML-I-2: Like ML-C-2, but in layer 5, IEC-A added at 0.064 and in layers 6 and 7, IEC-A added at 0.021.

ML-I-3: Like ML-C-3, but In layer 5, IEC-A added at 0.064 and in layers 6 and 7, IEC-A added at 0.021.

ML-I-4:: Like ML-I-3, but in layer 3, CDIR-1 reduced to 0.017 and IDIR-8 added at 0.043.

ML-I-5:: Like ML-I-3, but in layer 3, CDIR-1 reduced to 0.017 and IDIR-3 added at 0.060.

ML-I-6: In Layers 5 and 6, IEC-Q added at 0.0024, in layers 7 added at 0.0071.

ML-I-7: In layers 5 and 6, IEC-R added at 0.003, in layer 7 added at 0.008.

ML-I-8: Like ML-I-7, but in layer 9, IDIR-6 replaces IDIR-2 at 0.057 and in layer 10 at 0.50.

ML-I-9: Like ML-C-9, but IEC-S added to layer; 9 and 10 at 0.001

ML-I-10: Like ML-C-10, but IEC-S added to layers 9 and 10 at 0.001

ML-I-11: In layer 5, IEC-A added at 0.0068, in layer 6 at 0.0044 and in layer 7 at 0.0062.

ML-I-12: Like ML-C-0, but in layer 5, IEC-A added at 0.068, in layer 6 at 0.044 and in layer 7 at 0.062.

The structures of the materials used in the above experiments are as follows:

Dye-1:

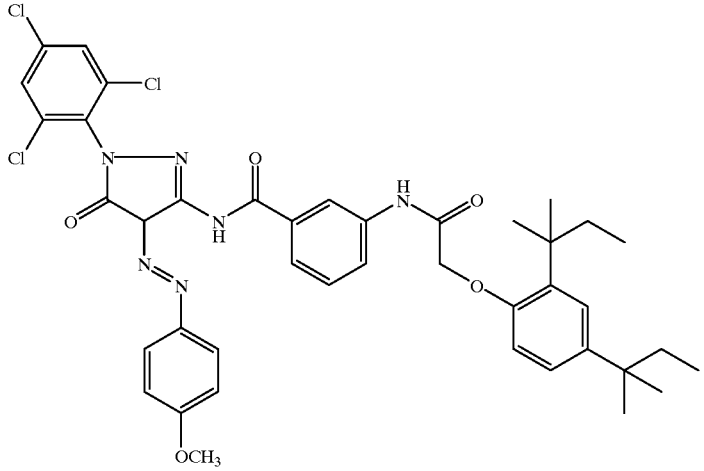

Dye-2:

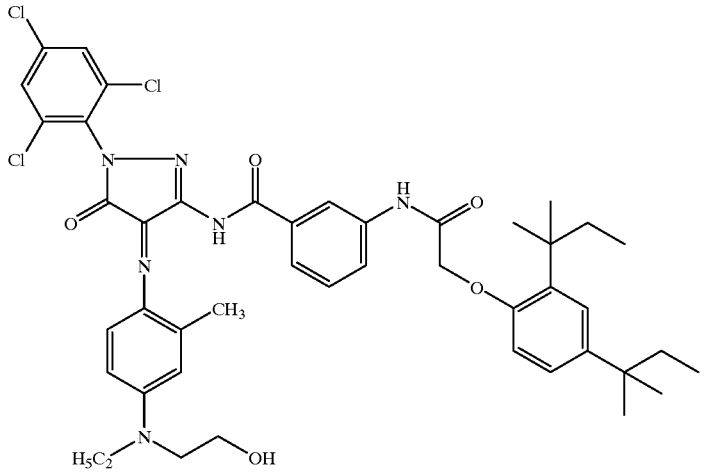

-continued
Dye-3:
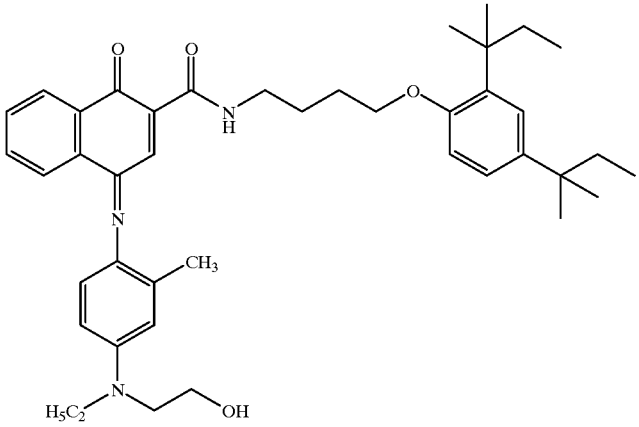
Dye-4:
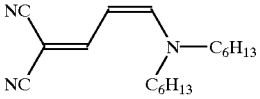
Dye-5:
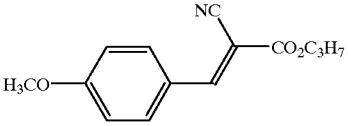
Dye-6:
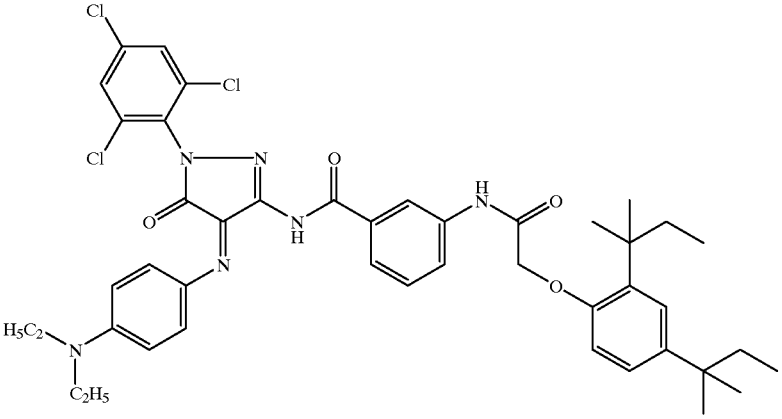
Dye-7:
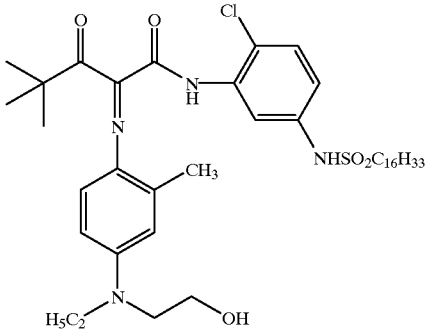

-continued
Dye-7:
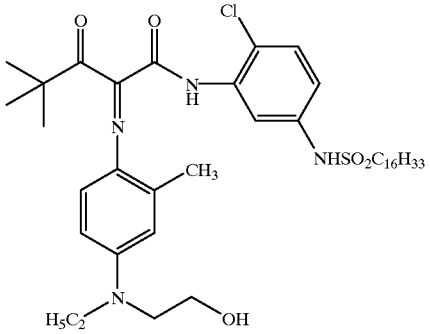
OxDS-1:
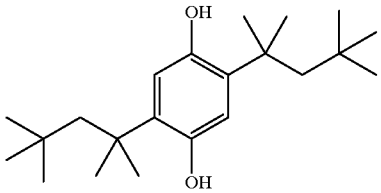
OxDS-2:
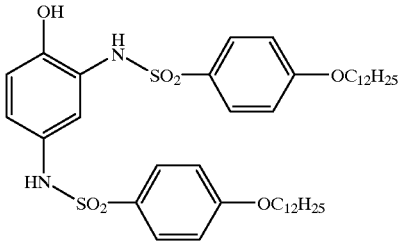
C-1:
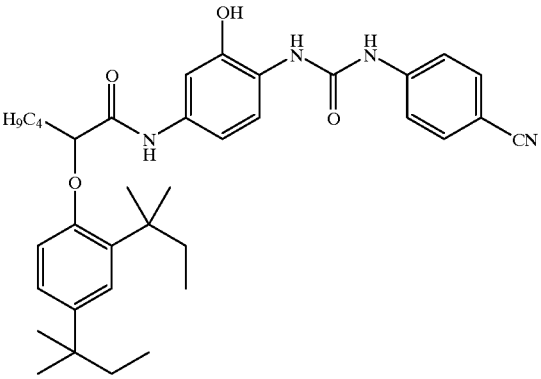
Y-2:
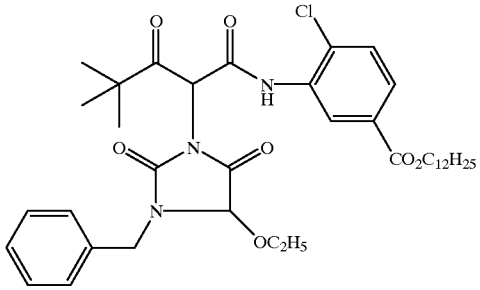

-continued
Y-3:
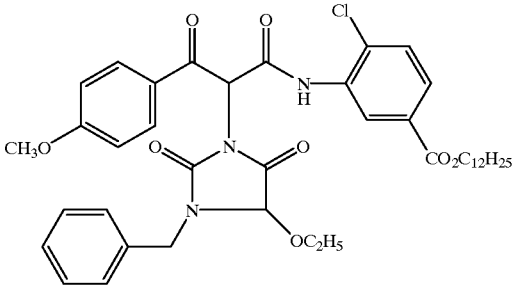
B-1:
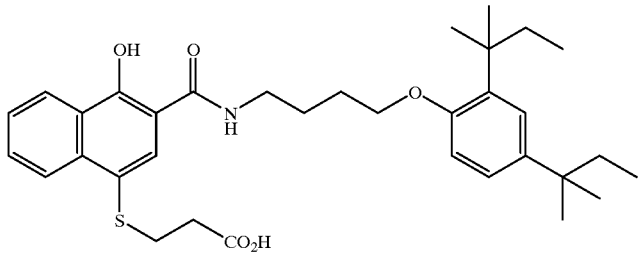
MC-1:
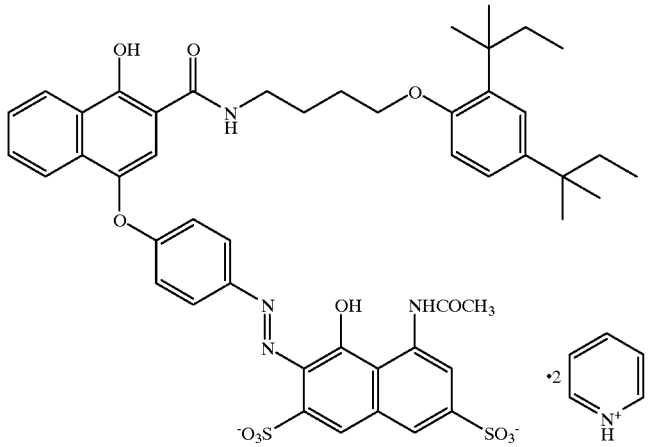
MC-2:
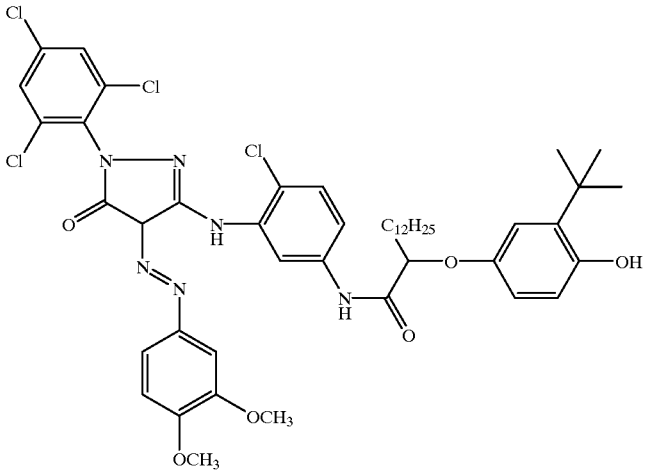

-continued
RSD-1:
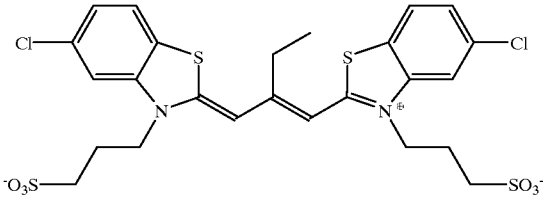
RSD-2:
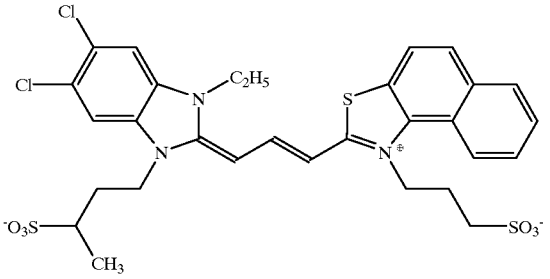
GSD-1:
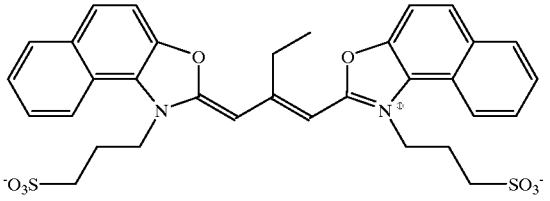
GSD-2:
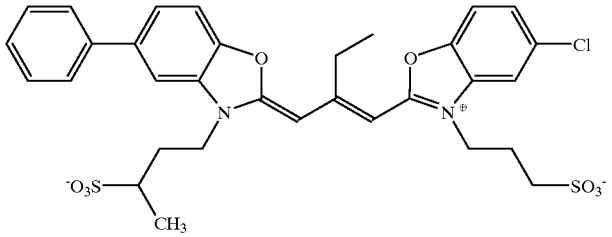
BSD-1:
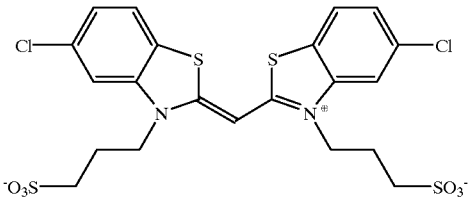

-continued

CIEC-8:

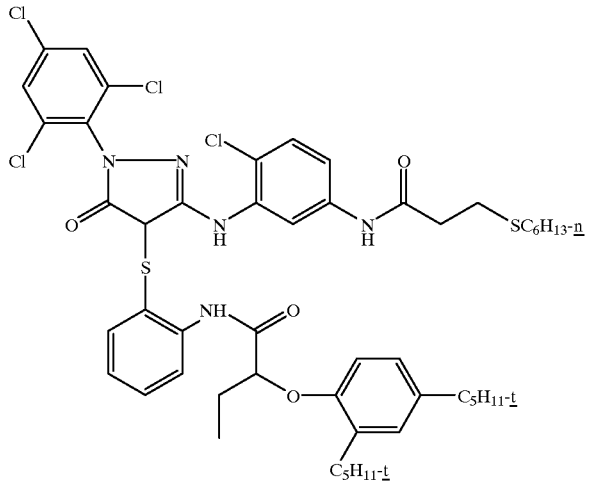

(17.52)

These multilayer coatings were given a stepped exposure in one color record but only flashed (non-imagewise exposure) in the other two records and processed as described for the bilayer experiments. To monitor interimage, a step nearest to density of 1.5 in the stepped color record (the causer) was chosen, and the difference in density of the other color records (the receivers) at that step and at the no exposure step of the causer was determined. A more negative number means a larger drop in density in the receiver and increased interimage. Relative blue sensitivity, a measure of speed, was determined by measuring the speed point +0.15 density units above Dmin and normalizing to the check position. Results are shown in Table III–VII.

TABLE III

Interimage in Multilayer Format - Laydown Variations - IDIR-2 in Blue Layers

| Sample | Comp/Inv | Ratio mmol IEC-A/mol silver Layer 5 | Layer 6 | Layer 7 | Interimage B→G |
|---|---|---|---|---|---|
| ML-C-0 | Comp | — | — | — | −0.021 |
| ML-C-10 | Comp | 0.17 | 0.17 | 0.17 | −0.026 |
| ML-I-11 | Inv | 1.7 | 1.7 | 1.7 | −0.077 |
| ML-I-12 | Inv | 17 | 17 | 17 | −0.130 |

Table III demonstrates that a mole ratio of IEC to silver of less than 1 mmol IEC to mol silver (based on AgBr) hardly gives any increase in interimiage in the presence of IDIR-2. Only at a mole ratio of greater than 1 does the increase in interimage become significant. At mole ratios higher than 5 or even 10, the increase in interimage is greater yet.

TABLE IV

Interimage in Multilayer Format - DIR Variations in Red Layer - IDIR-2 in Blue Layer

| Sample | Comp/Inv | IEC or CIEC | DIR in Red | Interimage R→G |
|---|---|---|---|---|
| ML-C-0 | Comp | — | CDIR-1 | −0.201 |
| ML-I-0 | (Comp) | IEC-A | CDIR-1 | −0.156 |

TABLE IV-continued

Interimage in Multilayer Format - DIR Variations in Red Layer - IDIR-2 in Blue Layer

| Sample | Comp/Inv | IEC or CIEC | DIR in Red | Interimage R→G |
|---|---|---|---|---|
| ML-C-1 | Comp | — | CDIR-1 + IDIR-8 | −0.199 |
| ML-I-1 | Inv | IEC-A | CDIR-1 + IDIR-8 | −0.261 |
| ML-C-2 | Comp | — | CDIR-1 + IDIR-3 | −0.310 |
| ML-I-2 | Inv | IEC-A | CDIR-1 + IDIR-3 | −0.330 |

Table IV demonstrates that the presence of a mild DIR in the red layer increases the interimage of the red layer onto the green layer whenever the IEC is present in the green layers. Note that ML-I-0 is used as a comparison in this table because the DIR in the red is not of the invention, even though this sample is inventive because it contains IDIR-2 in the blue layer.

TABLE V

Interimage in Multilayer Format - DIR Variations in the Blue Layer - CDIR-1 in Red Layer

| Sample | Comp/Inv | IEC or CIEC | DIR in Blue | Interimage B→G |
|---|---|---|---|---|
| ML-C-0 | Comp | — | IDIR-2 | −0.021 |
| ML-C-4 | Comp | CIEC-8 | IDIR-2 | −0.039 |
| ML-I-0 | Inv | IEC-A | IDIR-2 | −0.131 |
| ML-I-7 | Inv | IEC-Q | IDIR-2 | −0.051 |
| ML-I-8 | Inv | IEC-R | IDIR-2 | −0.033 |
| ML-C-3 | Comp | — | IDIR-6 | −0.005 |
| ML-C-6 | Comp | CIEC-8 | IDIR-6 | −0.029 |
| ML-I-3 | Inv | IEC-A | IDIR-6 | −0.050 |
| ML-I-9 | Inv | IEC-R | IDIR-6 | −0.020 |

Table V demonstrates improved interimage from the blue layer onto the green layer whenever the mild DIR of the invention is located in the blue layer and the IEC of the invention is located in the green.

TABLE VI

Interimage in Multilayer Format - DIR Variations in both Red and Blue Layers

| Sample | Comp/ Inv | IEC or CIEC | DIR in Red | DIR in Blue | Interimage B→G | Interimage R→G |
|---|---|---|---|---|---|---|
| ML-C-0 | Comp | — | CDIR-1 | IDIR-2 | −0.021 | −0.201 |
| ML-C-4 | Comp | CIEC-8 | CDIR-1 | IDIR-2 | −0.039 | −0.251 |
| ML-C-2 | Comp | — | CDIR-1 + IDIR-3 | IDIR-2 | −0.024 | −0.310 |
| ML-C-5 | Comp | CIEC-8 | CDIR-1 + IDIR-3 | IDIR-2 | −0.032 | −0.341 |
| ML-I-2 | Inv | IEC-A | CDIR-1 + IDIR-3 | IDIR-2 | −0.081 | −0.330 |
| ML-I-4 | Comp | IEC-A | CDIR-1 + IDIR-8 | IDIR-6 | −0.049 | −0.267 |
| ML-C-7 | Comp | CIEC-8 | CDIR-1 + IDIR-3 | IDIR-6 | −0.022 | −0.341 |
| ML-I-5 | Inv | IEC-A | CDIR-1 + IDIR-3 | IDIR-6 | −0.046 | −0.370 |

Table VI demonstrates that the mild DIRs of the invention in combination with an IEC can be used simultaneously in two other layers to improve the interimage from both.

TABLE VII

Interimage in Multilayer Format - IEC in Blue Layer

| Sample | Comp/Inv | IEC | DIR in Green | Interimage G→B | Relative Blue Sensitivity |
|---|---|---|---|---|---|
| ML-C-8 | Comp | — | IDIR-5 | −.203 | 1.00 |
| ML-I-10 | Inv | IEC-S | IDIR-5 | −.232 | 0.91 |
| ML-C-9 | Comp | — | IDIR-1 | −.221 | 0.99 |
| ML-I-11 | Inv | IEC-S | IDIR-1 | −.269 | 0.91 |

Table VII demonstrates the effectiveness of the invention when the IEC is located in the blue layer and the DIR of the invention is located in the green layer.

The invention has been described in detail with particular reference to preferred embodiments thereof, but it will be understood that variations and modifications can be effected within the scope and spirit of the invention.

What is claimed is:

1. A photographic element comprising:

a) a first light sensitive interimagze receiving silver halide emulsion layer containing a compound of Formula I:

$$COUP_1—(L)_n—A \qquad I$$

wherein

1) $COUP_1$ is a coupler parent group capable of forming a dye upon reaction with oxidized developer wherein $—(L)_n—A$ is not attached to the coupling position;

2) L is a divalent linking group bonding A to $COUP_1$, and n is 0 or 1; and

3) A is a fragment containing a group as identified by formulas IIIa, IIIb or IIIc:

IIIa

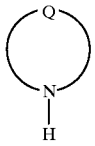

-continued

IIIb

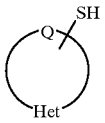

IIIc

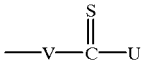

in which: Het represents a heteroatom; Q represents the atoms necessary to form a five or six-membered ring; V represents an atom of oxygen, sulfur, or nitrogen; and U represents an ether, thioether or amino group; provided that the indicated formulas encompass the addition of one or more fused rings; and provided that the ClogP for the compound of Formula I is not greater than 20; and b) a second light sensitive interimage causing silver halide emulsion layer containing a compound of Formula II:

$$COUP_2—(TIME)_j—INH \qquad II$$

wherein:

1) $COUP_2$ is a coupler parent group capable of forming a dye upon reaction with an oxidized developer;

2) TIME is a timing group and j is 0 or 1; and

3) INH is a mild silver development inhibitor fragment.

2. The color photographic element of claim 1 wherein A is a benzotriazole group with at least one N—H bond.

3. The color photographic element of claim 1 wherein A is a mercapotetrazole group with at least one S—H of N—H bond.

4. The color photographic element of claim 1 wherein the ClogP of the compound of Formula I is at least 6.25.

5. The color photographic element of claim 1 wherein the Clog P of the compound of Formula I is at least 7.0 but less than 17.0.

6. The color photographic element of claim 1 wherein the INH of the compound in Formula II contains a hydrolyzable group.

7. The color photographic element of claim 1 wherein the INH of the compound in Formula II is a mercaptotetrazole.

8. The color photographic element of claim 1 wherein the INH of the compound in Formula II is a N-alkyl mercaptotetrazole containing an ester group in the alkyl chain.

9. The color photographic element of claim 1 wherein j of the compound in Formula II is at least one.

10. The color photographic element of claim 1 wherein the INH of the compound in Formula II is a benzotriazole.

11. The color photographic element of claim 1 wherein the INH of the compound in Formula II is a triazole or tetrazole.

12. The color photographic element of claim 2 wherein the INH of the compound in Formula II is a mercaptotetrazole.

13. The color photographic element of claim 5 wherein the INH of the compound in Formula II is a mercaptotetrazole.

14. The color photographic element of claim 2 wherein the INH of the compound in Formula II is a benzotriazole.

15. The color photographic element of claim 5 wherein the INH of the compound in Formula II is a benzotriazole.

16. The color photographic element of claim 2 wherein the INH of the compound in Formula II contains a hydrolyzable group.

17. The color photographic element of claim 5 wherein the INH of the compound in Formula II contains a hydrolyzable group.

18. The color photographic element of claim 1 wherein the DIR is selected from the following compounds:

IDIR-1:

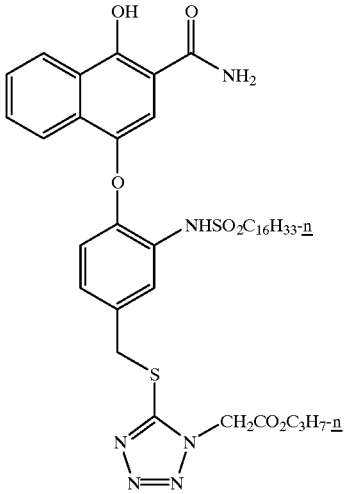

IDIR-2:

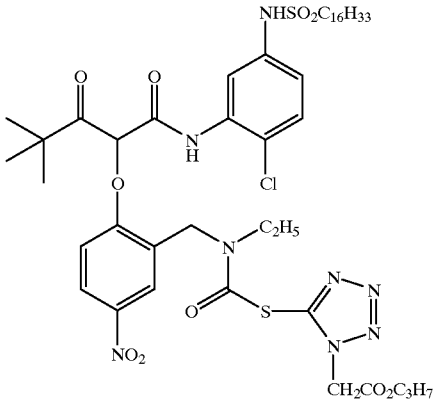

IDIR-3:

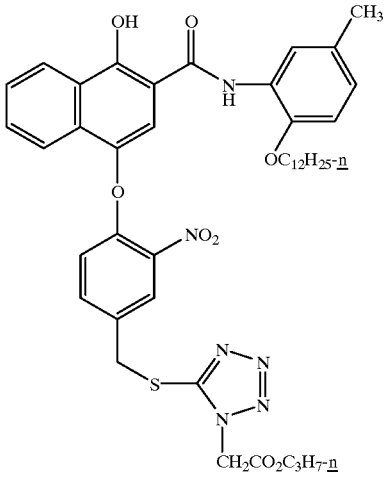

-continued

IDIR-8:

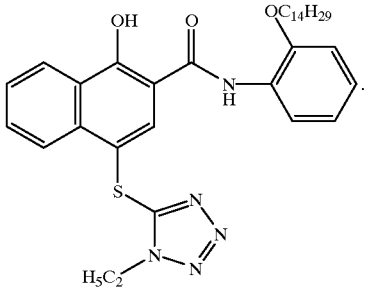

19. The color photographic element of claim 18 wherein A is a benzotriazole group with at least one —N—H bond.

20. The color photographic element of claim 18 wherein the ClogP of the compound of Formula I is at least 7.0 but less than 17.0.

21. The color photographic element of claim 1 wherein in the compound of Formula I is present in an amount of greater than 1 mmol per mole of silver.

22. The element of claim 1 wherein the emulsion in the first and second silver halide emulsion layers is a bromoiodide emulsion.

23. The element of claim 18 wherein the emulsion in the first and second silver halide emulsion layers is a bromoiodide emulsion.

24. The element of claim 1 wherein the dye formed by $COUP_1$ upon reaction with oxidized developer is a magenta dye.

25. The element of claim 18 wherein the dye formed by $COUP_1$ upon reaction with oxidized developer is a magenta dye.

26. The element of claim 1 wherein the dye formed by $COUP_1$ upon reaction with oxidized developer is a yellow dye.

27. The element of claim 18 wherein the dye formed by $COUP_1$ upon reaction with oxidized developer is a yellow dye.

28. A photographic element comprising:

a) a first light sensitive interimage receiving silver halide emulsion layer containing a compound of Formula II:

$$COUP_1—(L)_n—A \qquad I$$

wherein

1) $COUP_1$ is a coupler parent group capable of forming a dye upon reaction with oxidized developer wherein $—(L)_n—A$ is not attached to the coupling position;

2) L is a divalent linking group bonding A to $COUP_1$, and n is 0 or 1; and

3) A is a fragment containing a group as identified by formulas IIIa, IIIb or IIIc:

IIIa

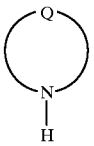

where Q provides a compound III selected from benzotriazoles, 1,2,3-triazoles, 1,2,4-triazoles, tri-, tetra-, and penta-azaindenes, oxazoles, thiazoles, selenazoles, oxadiazoles, thiadiazoles, tetrazoles, pyridines, purines, and pyrimidines;

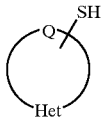

IIIb

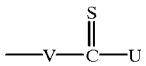

IIIc in which: Het represents a heteroatom; Q represents the atoms necessary to form a five or six-membered ring; V represents an atom of oxygen, sulfur, or nitrogen; and U represents an ether, thioether or amino group; provided that the indicated formulas encompass the addition of one or more fused rings; and provided that the ClogP for the compound of Formula I is not greater than 20; and b) a second light sensitive interimage causing silver halide emulsion layer containing a compound of Formula II:

$$COUP_2—(TIME)_j—INH \qquad II$$

wherein:

1) $COUP_2$ is a coupler parent group capable of forming a dye upon reaction with an oxidized developer;

2) TIME is a timing group and j is 0 or 1; and

3) INH is a mild silver development inhibitor fragment.

29. The element of claim 28 wherein the compound of formula I is represented by formula IIIa.

30. The element of claim 29 wherein the compound of formula IIIa is selected from triazoles, tetrazoles, purines, pyrimidines and pyridines.

* * * * *